US007958598B2

(12) United States Patent
Yun et al.

(10) Patent No.: US 7,958,598 B2
(45) Date of Patent: Jun. 14, 2011

(54) VACUUM CLEANER

(75) Inventors: Chang Ho Yun, Changwon-si (KR); Gun Ho Ha, Busan (KR); Jin Young Kim, Dongnae-gu (KR); Man Tae Hwang, Changwon-si (KR); Hae Seock Yang, Changwon-si (KR); Jong Su Choo, Busan (KR); Chang Hoon Lee, Changwon-si (KR); Jin Wook Seo, Busan (KR); Myung Sig Yoo, Changwon-si (KR); Moo Hyun Ko, Mungyeong-si (KR); Pil Jae Hwang, Gyeongsangnam-do (KR); Hyuk Min Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 35 days.

(21) Appl. No.: 11/965,133

(22) Filed: Dec. 27, 2007

(65) Prior Publication Data

US 2008/0172824 A1 Jul. 24, 2008

(30) Foreign Application Priority Data

Jan. 24, 2007 (KR) ..... 10-2007-0007359
Jan. 24, 2007 (KR) ..... 10-2007-0007362
Jan. 24, 2007 (KR) ..... 10-2007-0007363

(51) Int. Cl.
*A47L 9/10* (2006.01)

(52) U.S. Cl. ..... 15/353; 15/347; 15/352

(58) Field of Classification Search ..... 15/352, 15/353, 347, 327.1
See application file for complete search history.

(56) References Cited

U.S. PATENT DOCUMENTS

| | | | | | |
|---|---|---|---|---|---|
| 83,469 | A | | 10/1868 | Crandall | |
| 2,283,836 | A | * | 5/1942 | White | 55/429 |
| 2,714,426 | A | * | 8/1955 | White | 55/305 |
| 3,367,462 | A | | 2/1968 | Bibbens | |
| 4,379,385 | A | | 4/1983 | Reinhall | |
| 4,545,794 | A | | 10/1985 | Himukai | 55/362 |
| 4,601,082 | A | | 7/1986 | Kurz | |
| 4,617,034 | A | | 10/1986 | Ikezaki et al. | 55/276 |
| 4,809,394 | A | | 3/1989 | Suka et al. | 15/327 |
| 5,033,151 | A | | 7/1991 | Kraft et al. | |
| 5,135,552 | A | | 8/1992 | Weistra | |

(Continued)

FOREIGN PATENT DOCUMENTS

AU 2005229774 8/2006

(Continued)

OTHER PUBLICATIONS

Korean Office Action dated Mar. 25, 2008.

(Continued)

*Primary Examiner* — Lee D Wilson
*Assistant Examiner* — Jamal Daniel
(74) *Attorney, Agent, or Firm* — Ked & Associates LLP

(57) ABSTRACT

Disclosed related to a vacuum cleaner comprising a cleaner body in which a dust collector mount part is formed; a dust collector attached and removed at the dust collector mount part, and having a dust storage part in the inside; at least one of the compressing member reducing the volume of the dust stored in the dust storage part as arranged in the dust storage part movably; a power transfer unit transferring the driving force to the compressing members from outside as connected with the compressing members; and a control unit deciding the amount of the dust stored in the dust storage unit.

16 Claims, 21 Drawing Sheets

U.S. PATENT DOCUMENTS

| | | | | |
|---|---|---|---|---|
| 5,159,738 | A | 11/1992 | Sunagawa et al. | 15/326 |
| 5,233,682 | A | 8/1993 | Abe et al. | |
| 5,251,358 | A | 10/1993 | Moro et al. | |
| 5,265,305 | A | 11/1993 | Kraft et al. | |
| 5,323,483 | A | 6/1994 | Baeg | |
| 5,542,146 | A | 8/1996 | Hoekstra et al. | |
| 6,460,217 | B2 | 10/2002 | Fukushima et al. | 15/346 |
| 6,625,845 | B2 * | 9/2003 | Matsumoto et al. | 15/353 |
| 6,689,225 | B2 | 2/2004 | Illingworth | |
| 6,694,917 | B1 | 2/2004 | Wang | |
| 6,735,816 | B2 | 5/2004 | Oh et al. | 15/353 |
| 6,757,933 | B2 | 7/2004 | Oh et al. | 15/353 |
| 6,779,229 | B2 | 8/2004 | Lee et al. | 15/329 |
| 6,782,584 | B2 | 8/2004 | Choi | 15/352 |
| 6,922,868 | B1 | 8/2005 | Jeong | |
| 7,028,369 | B2 | 4/2006 | Park et al. | 15/353 |
| 7,152,276 | B2 * | 12/2006 | Jin et al. | 15/352 |
| 7,351,269 | B2 * | 4/2008 | Yau | 55/297 |
| 7,475,449 | B2 | 1/2009 | Lee | 15/326 |
| 7,481,868 | B2 * | 1/2009 | Lee et al. | 95/273 |
| 7,547,340 | B2 * | 6/2009 | Park | 55/429 |
| 7,582,128 | B2 * | 9/2009 | Hwang et al. | 55/337 |
| 7,601,188 | B2 * | 10/2009 | Hwang et al. | 55/343 |
| 7,608,123 | B2 * | 10/2009 | Pineschi | 55/429 |
| 7,640,625 | B2 * | 1/2010 | Oh et al. | 15/352 |
| 7,644,469 | B2 * | 1/2010 | Beers et al. | 15/319 |
| 7,647,672 | B2 * | 1/2010 | Nam et al. | 15/352 |
| 7,704,290 | B2 * | 4/2010 | Oh | 55/295 |
| 7,749,295 | B2 * | 7/2010 | Hwang et al. | 55/428 |
| 7,770,253 | B2 * | 8/2010 | Ha et al. | 15/319 |
| 7,785,381 | B2 * | 8/2010 | Oh et al. | 55/300 |
| 7,785,396 | B2 * | 8/2010 | Hwang et al. | 95/1 |
| 7,854,782 | B2 * | 12/2010 | Oh et al. | 55/429 |
| 2001/0025395 | A1 * | 10/2001 | Matsumoto et al. | 15/353 |
| 2002/0073505 | A1 | 6/2002 | Bolden | |
| 2002/0088079 | A1 | 7/2002 | Oh | |
| 2002/0124538 | A1 | 9/2002 | Oh et al. | |
| 2004/0211025 | A1 | 10/2004 | Jung et al. | |
| 2004/0261216 | A1 | 12/2004 | Choi et al. | 15/352 |
| 2005/0091787 | A1 | 5/2005 | Bair et al. | |
| 2005/0138763 | A1 | 6/2005 | Tanner et al. | |
| 2005/0172584 | A1 | 8/2005 | Oh et al. | |
| 2005/0252179 | A1 | 11/2005 | Oh et al. | |
| 2006/0123750 | A1 | 6/2006 | Lee et al. | |
| 2006/0230722 | A1 | 10/2006 | Oh et al. | |
| 2007/0136980 | A1 | 6/2007 | Fujiwara et al. | |
| 2007/0143953 | A1 * | 6/2007 | Hwang et al. | 15/353 |
| 2007/0209149 | A1 | 9/2007 | Lee | 15/352 |
| 2007/0209339 | A1 | 9/2007 | Conrad | |
| 2008/0023035 | A1 * | 1/2008 | Ha et al. | 134/18 |
| 2008/0023036 | A1 * | 1/2008 | Ha et al. | 134/21 |
| 2008/0047094 | A1 * | 2/2008 | Ha et al. | 15/347 |
| 2008/0052870 | A1 | 3/2008 | Lee et al. | |
| 2008/0172824 | A1 * | 7/2008 | Yun et al. | 15/352 |
| 2008/0172993 | A1 * | 7/2008 | Yun et al. | 55/337 |
| 2008/0263816 | A1 * | 10/2008 | Oh et al. | 15/347 |
| 2008/0264007 | A1 * | 10/2008 | Oh et al. | 55/304 |
| 2008/0264014 | A1 * | 10/2008 | Oh et al. | 55/423 |
| 2008/0264015 | A1 * | 10/2008 | Oh et al. | 55/429 |
| 2008/0264016 | A1 * | 10/2008 | Oh et al. | 55/429 |
| 2009/0178231 | A1 * | 7/2009 | Hwang et al. | 15/347 |
| 2009/0178235 | A1 * | 7/2009 | Yun et al. | 15/352 |
| 2009/0178236 | A1 * | 7/2009 | Yun et al. | 15/352 |
| 2009/0229072 | A1 * | 9/2009 | Hwang et al. | 15/352 |
| 2009/0229073 | A1 * | 9/2009 | Hwang et al. | 15/352 |
| 2009/0235956 | A1 * | 9/2009 | Hwang et al. | 134/21 |
| 2009/0241286 | A1 * | 10/2009 | Hwang et al. | 15/347 |
| 2009/0249578 | A1 * | 10/2009 | Hwang et al. | 15/352 |
| 2009/0255083 | A1 * | 10/2009 | Hwang et al. | 15/347 |
| 2009/0266382 | A1 * | 10/2009 | Hwang et al. | 134/21 |
| 2009/0293221 | A1 * | 12/2009 | Hwang et al. | 15/347 |
| 2009/0293223 | A1 * | 12/2009 | Hwang et al. | 15/352 |
| 2009/0293224 | A1 * | 12/2009 | Hyun et al. | 15/353 |
| 2009/0293915 | A1 * | 12/2009 | Hwang et al. | 134/21 |

FOREIGN PATENT DOCUMENTS

| | | | |
|---|---|---|---|
| AU | 2007200406 | B2 | 9/2007 |
| CN | 2162679 | | 4/1994 |
| CN | 2186039 | | 12/1994 |
| CN | 2409894 | | 12/2000 |
| CN | 1334061 | | 2/2002 |
| CN | 1434749 | A | 8/2003 |
| CN | 1593324 | | 3/2005 |
| CN | 1695537 | | 11/2005 |
| CN | 1695538 | | 11/2005 |
| CN | 1777385 | | 5/2006 |
| CN | 1778246 | | 5/2006 |
| DE | 102 40 618 | | 9/2003 |
| EP | 1 371 318 | A2 | 12/2003 |
| EP | 1 671 570 | | 6/2006 |
| EP | 1136028 | | 7/2006 |
| EP | 1 733 669 | | 12/2006 |
| EP | 1733669 | A1 * | 12/2006 |
| EP | 1857032 | | 11/2007 |
| FR | 2 823 091 | | 10/2002 |
| GB | 2 368 516 | | 5/2002 |
| GB | 2 377 881 | | 1/2003 |
| GB | 2 388 769 | | 4/2004 |
| GB | 2404887 | | 2/2005 |
| GB | 2 406 064 | | 3/2005 |
| GB | 2416721 | | 2/2006 |
| JP | 50-022355 | | 3/1975 |
| JP | 53-51663 | | 5/1978 |
| JP | 54-28457 | | 3/1979 |
| JP | 54-85560 | | 7/1979 |
| JP | 54-085561 | | 7/1979 |
| JP | 54-119272 | | 8/1979 |
| JP | 54-114358 | | 9/1979 |
| JP | 54-114366 | | 9/1979 |
| JP | 54-114367 | | 9/1979 |
| JP | 54161751 | | 12/1979 |
| JP | 55-74553 | | 6/1980 |
| JP | 58-84066 | A | 5/1983 |
| JP | 58-175532 | | 10/1983 |
| JP | 58-218934 | | 12/1983 |
| JP | 64-029246 | | 1/1989 |
| JP | 02-007927 | | 1/1990 |
| JP | 4-116933 | U | 10/1992 |
| JP | 06-054778 | | 3/1994 |
| JP | 7-241265 | | 9/1995 |
| JP | 408000514 | | 1/1996 |
| JP | 08-112223 | A | 5/1996 |
| JP | 08-140907 | | 6/1996 |
| JP | 10-243900 | | 9/1998 |
| JP | 11-004789 | | 1/1999 |
| JP | 2000-262449 | | 9/2000 |
| JP | 2002-143060 | | 5/2002 |
| JP | 2002-187336 | | 7/2002 |
| JP | 2002-360474 | | 12/2002 |
| JP | 2003-019097 | | 1/2003 |
| JP | 2003-119575 | | 4/2003 |
| JP | 2003-125995 | | 5/2003 |
| JP | 2003-190056 | A | 7/2003 |
| JP | 2003-199695 | | 7/2003 |
| JP | 2003-310502 | | 11/2003 |
| JP | 2003-310506 | A | 11/2003 |
| JP | 2004-065357 | | 3/2004 |
| JP | 2004-528087 | A | 9/2004 |
| JP | 2005-34213 | | 2/2005 |
| JP | 06-061439 | | 3/2006 |
| JP | 2006-068500 | | 3/2006 |
| JP | 3119575 | | 3/2006 |
| JP | 2007-007381 | A | 1/2007 |
| JP | 2008-73066 | | 4/2008 |
| JP | 2003-524522 | | 8/2008 |
| KR | 1993-0008369 | | 8/1993 |
| KR | 2002-0091510 | | 12/2002 |
| KR | 10-2005-0005611 | | 1/2005 |
| KR | 10-2005-013694 | | 2/2005 |
| KR | 10-0546629 | B1 | 1/2006 |
| KR | 10-0553042 | B1 | 2/2006 |
| KR | 10-2006-031442 | | 4/2006 |
| KR | 2006-0116992 | | 11/2006 |
| KR | 10-0730956 | | 6/2007 |

| | | |
|---|---|---|
| KR | 10-2004-084834 | 8/2007 |
| KR | 10-2007-088022 | 8/2007 |
| KR | 10-0800188 | 1/2008 |
| KR | 10-0800189 | 1/2008 |
| KR | 10-0838886 | 6/2008 |
| KR | 10-0838887 | 6/2008 |
| RU | 2172132 | 8/2001 |
| RU | 2 243 714 | 1/2005 |
| RU | 2 269 919 | 9/2005 |
| SU | 1326236 | 7/1987 |
| WO | WO 00/74548 | 12/2000 |
| WO | WO/01/35809 | 5/2001 |
| WO | WO 01/60524 | 8/2001 |
| WO | WO 2004/064591 | 8/2004 |
| WO | WO2005099545 | 10/2005 |

OTHER PUBLICATIONS

Korean Office Action dated Sep. 30, 2008.
Chinese Office Action dated Aug. 21, 2009.
U.S. Office Action dated Oct. 6, 2009.
Korean Office Action dated Aug. 29, 2008.
Japanese Office Action dated Sep. 18, 2008.
International Search Report and Written Opinion dated Dec. 10, 2008.
Japanese Office Action dated Dec. 24, 2008.
Chinese Office Action dated Feb. 6, 2009.
Japanese Office Action dated Mar. 12, 2009.
Japanese Office Action dated Mar. 13, 2009.
Chinese Office Action dated Apr. 3, 2009 (translation).
Chinese Office Action dated May 8, 2009 (translation).
Japanese Office Action dated May 22, 2009.
Chinese Office Action dated Jun. 5, 2009 (translation).
European Search Report dated Jun. 16, 2009 (in English).
Korean Office Action dated Jun. 19, 2009.
Chinese Office Action dated Jul. 3, 2009 (with translation).
Japanese Office Action dated Jul. 28, 2009 (with translation).
U.S. Office Action dated Feb. 11, 2008 (U.S. Appl. No. 11/831,473).
U.S. Office Action dated Feb. 11, 2008 (U.S. Appl. No. 11/831,564).
U.S. Office Action dated Jul. 24, 2008 (U.S. Appl. No. 11/831,473).
U.S. Office Action dated Jul. 28, 2008 (U.S. Appl. No. 11/712,958).
U.S. Office Action dated Aug. 28, 2008 (U.S. Appl. No. 11/713,022).
U.S. Office Action dated Sep. 19, 2008 (U.S. Appl. No. 11/831,564).
U.S. Office Action dated Oct. 20, 2008 (U.S. Appl. No. 11/831,473).
U.S. Office Action dated Mar. 9, 2009 (U.S. Appl. No. 11/713,022).
U.S. Office Action dated May 28, 2009 (U.S. Appl. No. 11/831,473).
U.S. Office Action dated Sep. 3, 2009 (U.S. Appl. No. 11/831,564).
U.S. Office Action dated Sep. 10, 2009 (U.S. Appl. No. 11/565,241).
European Search Report dated Oct. 15, 2009.
Japanese Office Action dated Nov. 4, 2009.
Canadian Office Action dated Nov. 18, 2009 (2).
European Search Report dated Jan. 20, 2010.
Chinese Office Action dated Feb. 5, 2010. (with translation).
U.S. Appl. No. 11/565,241 Notice of Allowance dated Feb. 19, 2010.
U.S. Appl. No. 11/831,564 Notice of Allowance dated Feb. 24, 2010.
Korean Office Action dated Mar. 18, 2010.
Korean Office Action dated Mar. 25, 2010.
U.S. Office Action U.S. Appl. No. 11/565,206 dated Apr. 19, 2010.
U.S. Notice of Allowance U.S. Appl. No. 11/831,519 dated Apr. 21, 2010.
Candian Office Action dated Jun. 30, 2010.
U.S. Office Action U.S. Appl. No. 12/408,066 dated Jul. 23, 2010.
U.S. Office Action U.S. Appl. No. 12/406,779 dated Aug. 18, 2010.
U.S. Office Action U.S. Appl. No. 11/831,473 dated Sep. 1, 2010.
Russian Office Action dated Sep. 28, 2007 issued in Application No. 2007103559 (translation only).
Australian Office Action dated Apr. 17, 2008 issued in Application No. 2007200408.
Russian Office Action dated Apr. 21, 2008 issued in Application No. 2007103560 (with translation).
Australian Office Action dated Jun. 3, 2008 issued in Application No. 2006249267.
Australian Office Action dated Apr. 16, 2009 issued in Application No. 2008200340.
Chinese Office Action dated Aug. 21, 2009 issued in Application No. 200710002991.7 (with translation).
U.S. Office Action U.S. Appl. No. 11/831,473 dated May 14, 2010.
U.S. Office Action U.S. Appl. No. 12/406,803 dated May 26, 2010.
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
Russian Office Action dated Oct. 4, 2007 (2007103555) (translation).
Australian Office Action dated Apr. 15, 2008 (2007200407).
Australian Office Action dated Apr. 24, 2008 (2007200409).
European Office Action dated May 8, 2008 (07101388.Feb. 2316).
Chinese Office Action dated Dec. 12, 2008 (200710002992.1) (translation).
Chinese Office Action dated May 22, 2009 (200710002992.1) (translation).
Chinese Office Action dated Nov. 13, 2009 (200710085701.X) (translation).
Chinese Office Action dated Dec. 11, 2009 (200710002992.1).
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
European Search Report dated Jan. 27, 2011. (Application No. 06125798.6-2316/1852048).
Russian Office Action dated Feb. 2, 2011 (Application No. 2009143355) (with translation).
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.

* cited by examiner

VACUUM CLEANER

The present application claims priority under 35 U.S.C. 119 and 35 U.S.C. 365 to Korean Patent Application No. 10-2007-0007359 (filed on Jan. 24, 2007), 10-2007-0007362 (filed on Jan. 24, 2007), 10-2007-0007363 (filed on Jan. 24, 2007), which is hereby incorporated by reference in its entirety.

BACKGROUND

1. Field

This document relates to a vacuum cleaner.

2. Description of the Related Art

In general, a vacuum cleaner is an apparatus filtering dust in the body of the machine after inhaling the air including dust as using vacuum pressure generated from a suction motor equipped in the body.

The conventional vacuum cleaner comprises a suction nozzle inhaling the air including dust, a body of the cleaner connected with the suction nozzle an extended pipe leading the air inhaled through the suction nozzle toward the body of the cleaner, and a connection pipe connecting the air passed through the extended pipe to the body of the cleaner.

Here, a nozzle intake of a predetermined size is formed at the bottom of the suction nozzle so as to inhale the air including dust on the floor.

On the other hand, a driving device generating suction power is equipped in the body of the cleaner so as to inhale the outer air including dust through the suction nozzle.

Further, a dust collector separating and storing the air is separately provided in the body of the cleaner. The dust collector performs the function of separating and storing the dust in the air inhaled through the suction nozzle.

SUMMARY

The implementations of a vacuum cleaner comprise a cleaner body in which a dust collector mount part is formed and a dust collector capable of removing form the dust collector mount part and having dust storage part in the inside. At least one of compressing member reducing the volume of the dust stored in the dust storage part is arranged movably in the dust storage unit. A power transfer unit transferring driving power to the compressing member from outside is connected to the compressing member. A control unit decides the storing amount of the dust in the dust storage unit.

BRIEF DESCRIPTION OF THE DRAWINGS

Drawings are provided on the following for further understanding of the implementations of a vacuum cleaner.

DETAILED DESCRIPTION

Hereinafter, reference will now be made in detail as for the implementation s of a vacuum cleaner with reference to the accompanying drawings.

Figure 1:
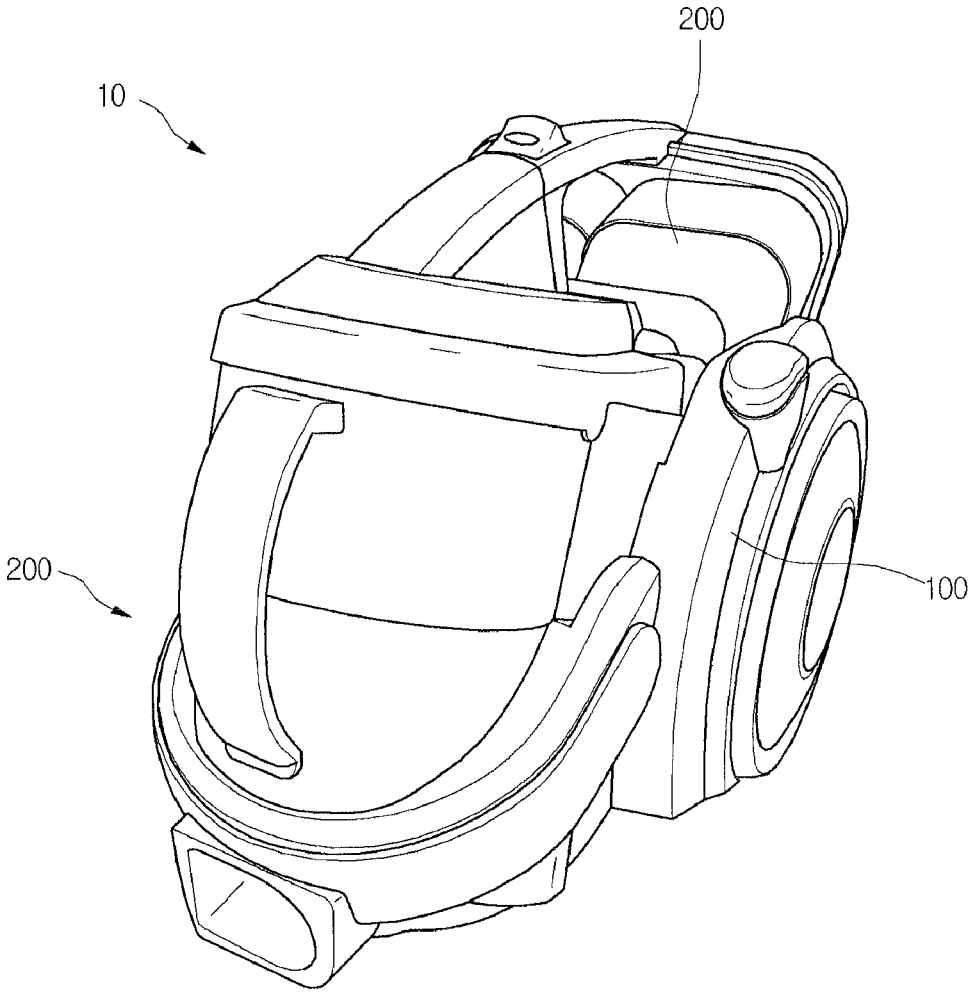
FIG. 1 is a perspective view of a vacuum cleaner.
Figure 2:
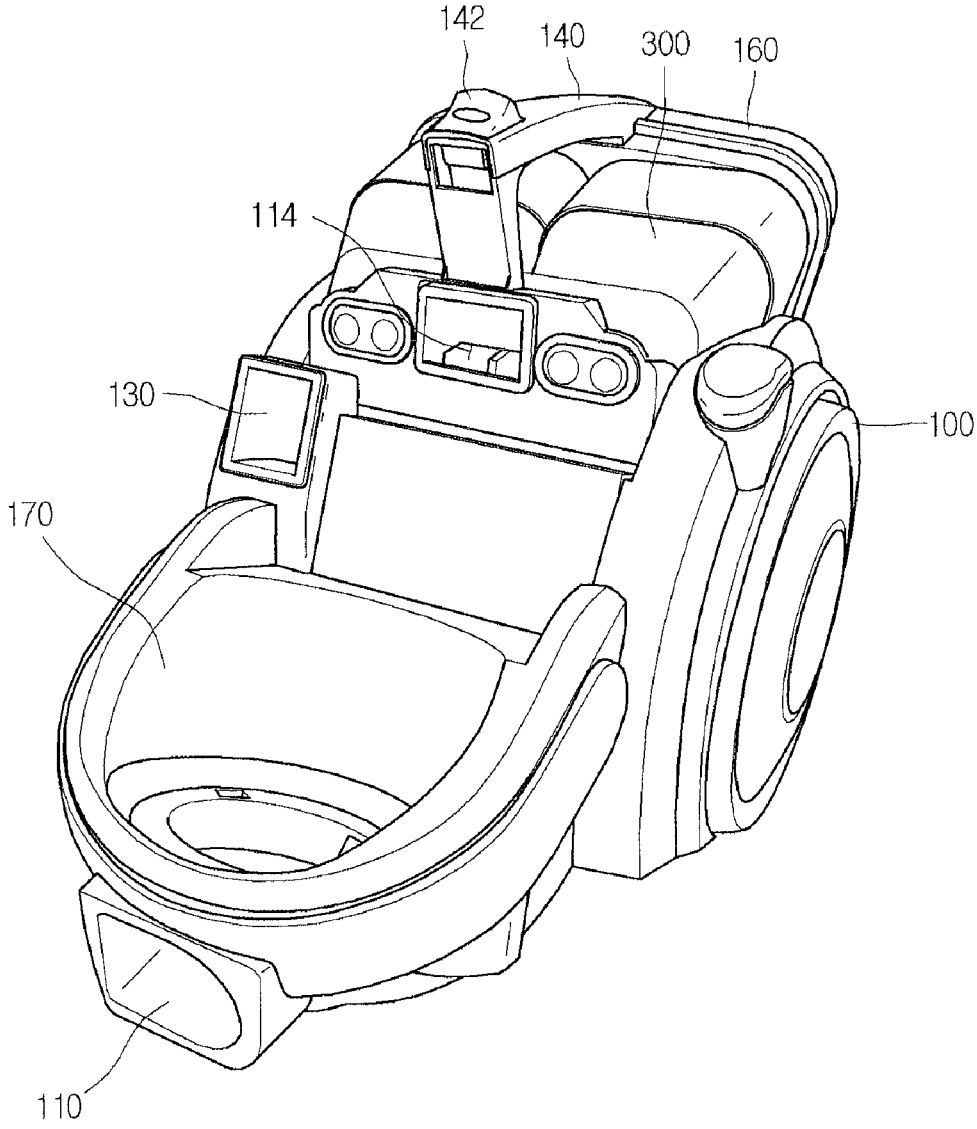
FIG. 2 is a perspective view illustrating the state that the dust collector is separated from the vacuum cleaner.

FIG. 1 is a perspective view of a vacuum cleaner. FIG. 2 is a perspective view illustrating the state that the dust collector is separated from the vacuum cleaner, and FIG. 3 is a perspective view of a dust collector.

Figure 3:
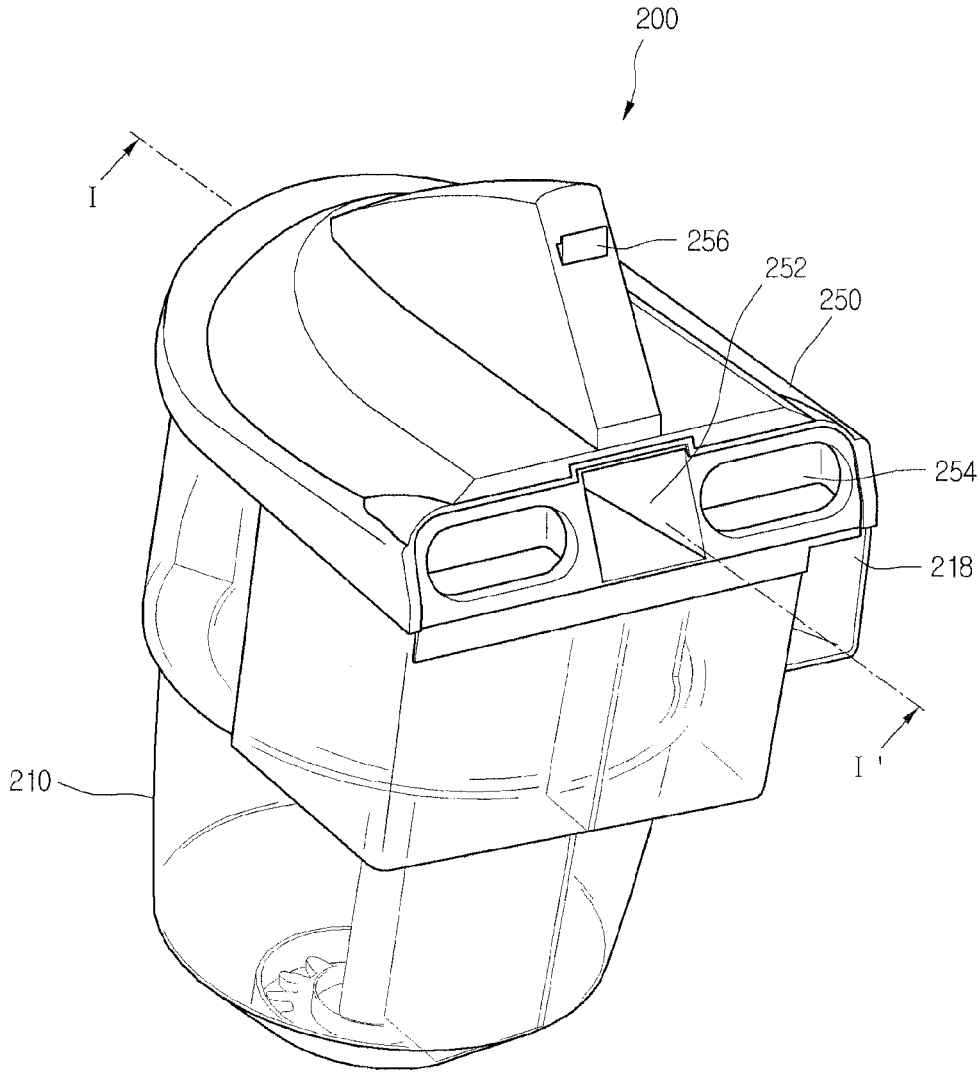
FIG. 3 is a perspective view of a dust collector.

Referring to FIGS. 1 to 3, the vacuum cleaner 10 comprises a cleaner body 100 having a suction motor (not illustrated) generating suction power in the inside and a dust separating means separating dust included in the air inhaled into the cleaner body 100.

Further, even though it is not illustrated, a suction nozzle inhaling the air including dust and a connection pipe connecting the suction nozzle to the cleaner body 100 are comprised.

The detailed description for the basic composition of the suction nozzle and the connection pipe of the present embodiment is omitted, as it is the same to the related art.

Particularly, a cleaner body inlet 110 inhaling the air including dust inhaled through the suction nozzle is formed at the lower end of the front of the cleaner body 100, and a cleaner body exhaust unit—not illustrated—exhausting the air separated with the dust is formed at a side of the cleaner body 100.

A handle unit 140 is formed at the upper part of the cleaner body 100 for the users to grab it.

Further, a guide cover 160 is coupled to the rear side of the cleaner body 100 to guide the air separated with the dust by dust separating means to be flown into the cleaner body 100.

The dust separating means is composed of a dust collector 200 having the first cyclone unit (it will be described later) separating the dust included in the air flown into the inside primarily, and the second cyclone unit 300 separating the dust once more from the air separated with the dust primarily through the first cyclone unit and arranged in the cleaner body 100.

More particularly, the dust collector 200 is selectively mounted to the dust collector mount part 170 formed at the front of the cleaner body 100.

A release lever 142 is equipped at the handle unit 140 of the cleaner body to attach and remove the dust collector 200 to and from the cleaner body 100, and an engagement end 256 engaged with the release lever 142 is formed at the dust collector 200.

Further, the dust collector 200 includes a first cyclone unit generating the cyclone movement and a dust collecting body 210 having a dust storage part storing the dust separated in the first cyclone unit.

Here, the dust collector 200 is mounted as attached and removed to and from the cleaner body 100 as described above, and the dust collector 200 is connected with the cleaner body 100 and the second cyclone unit 300 as the dust collector is mounted at the cleaner body 100.

Particularly, an air outlet 130 exhausting the air inhaled to the cleaner body 100 to the dust collector 200 is formed in the cleaner body 100 and a first air inlet 218 inhaling the air from the air outlet 130 is formed in the dust collector 200.

Here, it is desirable for the first air inlet 218 to be formed in the connected direction of the dust collector 200 to generate the cyclone movement in the dust collector 200.

Further, a first air outlet 252 exhausting the air separated with the dust in the first cyclone unit is formed in the dust collector 200, and a connection path 114 inhaling the air exhausted through the first air outlet 252 is formed at the cleaner body 100.

Furthermore, the air inhaled into the connection path 114 is inhaled into the second cyclone unit 300.

The second cyclone unit 300 is composed of a union of a plurality of cone-shaped cyclones. Further, the cyclone unit 300 is arranged as lied on the upper side of the rear of the cleaner body 100. That is, the second cyclone unit 300 is arranged as inclined in a predetermined angle against the cleaner body 100.

As described above, the profits for using spaces is improved in the arrangement relation of the vacuum cleaner that the miniaturization is required with the suction motor and etc as arranging the second cyclone unit 300 to be lied down on the cleaner body 100.

Further, the structure of the dust collector 200 becomes simplified and users can treat the dust collector 200 with lower energy as the weight of the dust collector 200 becomes lighter, as the second cyclone unit 300 is separated from the dust collector 200 and arranged in the cleaner body 100.

Here, the dust separated in the second cyclone unit 300 is stored in the dust collector 200. For this, a dust inlet 254 inhaling the dust separated in the second cyclone unit 300 and a dust storage part storing the dust separated in the second cyclone unit 300 are further formed in the dust collector 210.

That is, the dust storage part formed in the dust collector body 210 is composed of a first dust storage part storing the dust separated by the first cyclone unit and a second dust storage part storing the dust separated by the second cyclone unit 300.

That is, the second cyclone unit 300 is composed in the cleaner body 100 as separated from the dust collector 200, but the dust separated in the second cyclone unit 300 is stored in the dust collector 200 in the present embodiment.

Here, it is desirable that the second cyclone unit 300 is arranged as inclined toward the dust collector for the separated dust to be moved to the dust collector 200 easily.

Further, it is desirable for the dust collector 200 to be composed to maximize the dust collecting capacity of the dust stored in the inside. For this, it is desirable that a composition reducing the volume of the dust stored in the dust collector body 210 is added to the dust collector 200.

Reference will now be made in detailed as for the vacuum cleaner having a dust collector maximizing the dust collecting capacity.

Figure 4:
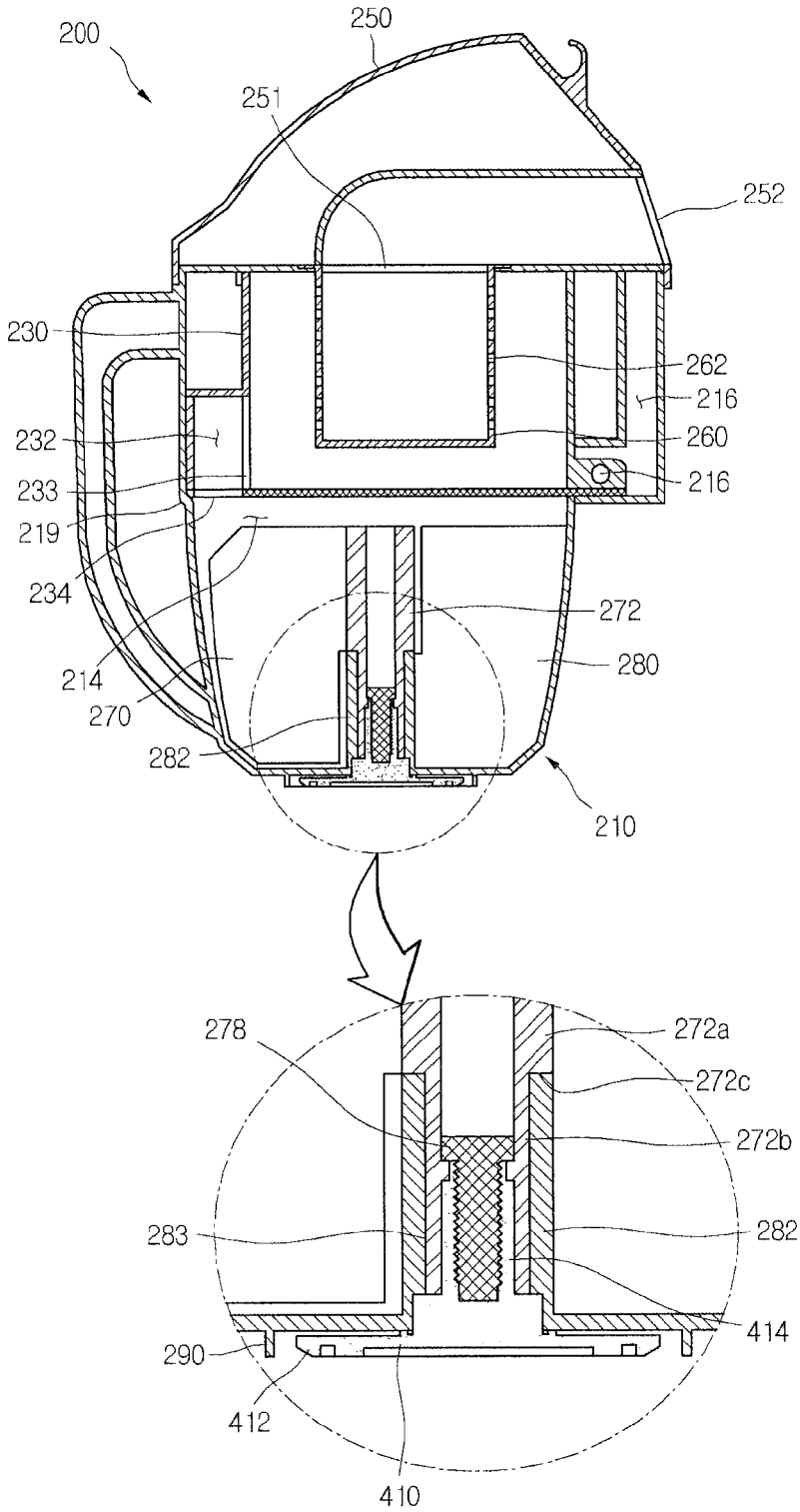
FIG. 4 is a cross-sectional view taken along I-I' of FIG. 3.
Figure 5:
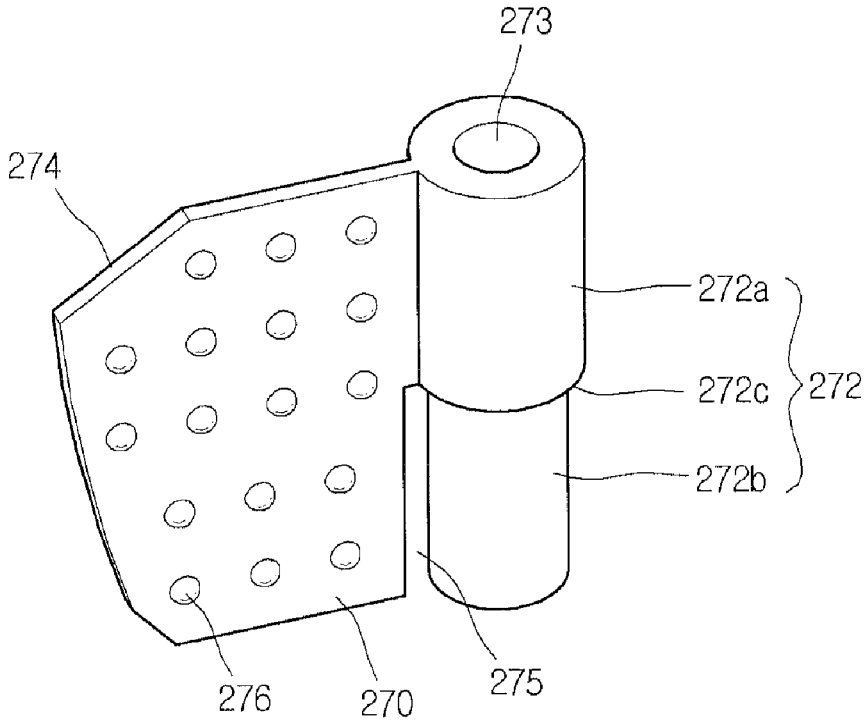
FIG. 5 is a perspective view of a first compressing member.

FIG. 4 is a cross-sectional view operated along I-I' in FIG. 3,

Referring to FIGS. 4 and 5, the dust collector 200 comprises a dust collector body 210 forming the external shape, a first cyclone unit 230 arranged in the dust collector body 210 selectively and separating dust from the inhaled air, and a cover member 250 opening and closing the top of the dust collector body 210 selectively.

Particularly, the dust collector body 210 is formed as nearly rounded shape, and a dust storage part storing the separated dust in the inside.

The dust storage part includes a first dust storage part 214 storing the dust separated in the first cyclone unit 230 and a second dust storage part 216 storing the dust separated in the second cyclone unit 300.

Here, the dust collector body 210 includes a first wall 211 forming the first dust storage part 214, and a second wall 212 forming the second dust storage part 216 as related with the first wall 211. That is, the second wall 212 covers a predetermined part of the outer side of the first wall 211.

Therefore, the second dust storage part 216 is formed at the outer side of the first dust storage part 214.

The dust collecting capacity of the first dust storage part 214 is maximized, as the size of the first dust storage part 214 is maximized as arranging the second dust storage part 216 at the outer side of the first dust storage part 214.

A bent portion 219 supporting the lower end of the first cyclone unit 230 arranged in the first wall 211 is formed at the first wall 211 in the circumferential direction. Therefore, the upper part of the first dust storage part 214 has a diameter bigger than the diameter of the lower part at the end projection 219 as a standard.

The top of the dust collecting body 210 is opened for the users to empty the dust as turning the dust collector body 210 upside down, and the cover member 250 is coupled with the upper part of the dust collector body 210.

Further, the first cyclone unit 230 is coupled at the lower side of the cover member 250 to be capable of separated with the cover member 250 while emptying the dust stored in the dust collector body 210.

Here, the present embodiment is composed as the first cyclone unit 230 is coupled with the cover member 250, but it is possible that the first cyclone unit 230 and the cover member 250 are formed in a single structure.

A dust guide path 232 guiding the dust separated from the air to be exhausted into the first dust storage part 214 easily is supplied in the first cyclone unit 230.

Here, the dust guide path 232 guides the separated dust to be fall down after flown through the tangential direction.

Therefore, the inlet 233 of the dust guide path 232 is formed at the lateral face of the first cyclone unit 230, and the outlet 234 is formed at the bottom of the first cyclone unit 230.

The cover member 250 is coupled with the upper side of the dust collector body 210 as described above. That is, the cover member 250 opens and closes the first dust storage part 214 and the second dust storage part 216 at the same time.

Therefore, the top of the dust collector body 210 is completely opened when a user separates the cover member 250 coupled with the first cyclone unit 230 from the dust collector body 210 to discharge the dust stored in the first dust storage part 214 and the second dust storage part 216 to outside. Further, when the user turns the dust collector body 210 upside down, the dust is easily emptied.

At this time, the re-pollution of the cleaned interior is prevented, as a user separates the cover member 250 from the dust collector body 210 at the outside or above the trash box to empty the dust collector body 210.

Further, a discharge hole 251 exhausting the air separated from the dust in the first cyclone unit 230 is penetrated the bottom of the cover member 250. Further, the discharge hole 251 is coupled with the top of the filter member 260 having a plurality of voids 262 of predetermine size on the outer circumferential surface.

Therefore, the air passed the first dust separating process in the first cyclone unit 230 is exhausted into the discharge hole 251 after passing through the filter member 260.

Further, a path 253 is formed in the cover member 250 to guide the air in the first cyclone unit 230 exhausted from the discharge hole 251 to be flown to the first air outlet 252. That is, the path 253 is a path connecting the discharge hole 251 and the first air outlet 252.

Meanwhile, a pair of compressing members 270 and 280 is arranged in the dust collector body 210 to increase the dust collecting capacity as reducing the volume of the dust stored in the first dust storage part 214.

Here, the pair of compressing members 270 and 280 reduces the volume of the dust due to the interaction between each other, and accordingly increases the maximum dust collecting capacity of the dust collector body 210 as increasing the density of the dust stored in the dust collector body 210.

One of the pair of compressing members 270 and 280 is called as the first compressing member 270 and the other is called as the second compressing member 280 on the following for the convenience of description.

In the present embodiment, at least one of the compressing members 270 and 280 compresses dust as arranged movably in the dust collector body 210.

When the first compressing member 270 and the second compressing member 280 are arranged rotated in the dust collector 210, the first compressing member 270 and the second compressing member 280 rotate toward each other. Further, the distance between a side of the first compressing member 270 and a side of the second compressing member 280 corresponding to the side of the first compressing member 270 becomes narrow while the compressing members 270 and 280 rotate toward each other, and accordingly, the dust located between the first compressing member 270 and the second compressing member 280 is compressed.

Merely, in the present embodiment, the first compressing member 270 is supplied into the dust collector body 210, and the second compressing member 280 is fixed in the dust collecting body 210.

Therefore, the first compressing member 270 becomes a rotating member, and the second compressing member 280 becomes a fixed member.

Particularly, it is desirable for the second compressing member 280 to be supplied to the interval between the rotating shaft 272 and the axis, the center of the rotation of the inner circumferential surface of the dust collector body 210 and the first compressing member 270.

That is, the second compressing member 280 is arranged on the surface connecting the axis of the rotating shaft 272 and the inner circumferential surface of the first dust storage part 214. At this time, the second compressing member 280 compresses dust with the first compressing member 270 as covering the entire or a part of the space between the inner circumferential surface of the first dust storage part 214 and the axis of the rotating shaft when the dust is closed to the second compressing member 280 as pushed by the first compressing member 270.

For this, it is desirable that an end of the second compressing member 280 is formed at the inner circumferential surface of the dust collector body 210 in a single structure, and that the other end is formed at the rotating shaft 272 of the first compressing member 270 and the fixed shaft 282 arranged on the rotating shaft 272 in a single structure.

It is also possible that the only one end of the second compressing member 280 is formed in a single structure with the inner circumferential surface of the dust collector body 210, or that the other end is formed in a single structure with the fixed shaft 282. That is, the second compressing member 280 is fixed at least one between the inner circumferential surface of the dust collector body 210 and the fixed shaft 282.

However, it is desirable that an end of the second compressing member 280 is close to the inner circumferential surface, though an end of the second compressing member 280 is not formed in a single structure with the inner circumferential surface of the dust collector body 210.

Further, it is desirable that the other end of the second compressing member 280 is close to the fixed shaft 282, though the other end of the second compressing member 280 is not formed in a single structure with the fixed shaft 282.

It is to minimizing the leak of the dust pushed by the first compressing member 270 to out side through a gap formed at the lateral part of the second compressing member 280.

It is desirable for the first compressing member 270 and the second compressing member 280 to be formed in the shapes of squared plate. Further, it is desirable for the rotating shaft 272 of the first compressing member 270 to be arranged on the axis being the center of the dust collector body 210 and the same axle.

Furthermore, it is desirable that a multitude of compressing protrusions 276 is formed on the outer surface of the first compressing member 270. The compressing protrusions 276 compresses the dust effectively while compressing dust as the first compressing member 270 is moved toward the second compressing member 280.

Further, it is desirable that a chamfer 274 chamfered with a predetermine angle is formed at the upper end of the first compressing member 270. The chamfer 274 let the dust discharged easily through the outlet 234 as forming a space between the outlet 234 and the first compressing member 270 when the upper end of the first compressing member 270 is located at the lower side of the outlet 234.

The fixed shaft 282 is protruded toward the inside from an end of the dust collector body 210, and a hollow 283 penetrated in the shaft direction is formed in the fixed shaft 282 to assemble the rotating shaft 272. Further, a predetermined part of the rotating shaft 272 is inserted into the hollow 283 from the upper side of the fixed shaft 282.

Particularly, a step unit 272*c* supported at the top of the fixed shaft 282 is formed at the rotating shaft 272, and the rotating shaft 272 is divided into the upper shaft 272*a* that the first compressing member 270 is formed and the lower shaft 272*b* that the driven gear—described later—is connected with to rotate the first compressing member 270 with the step unit 272*c* as a standard.

Further, an interference prevention groove 275 is formed at the first compressing member 270 to prevent the interference of the first compressing member 270 and the fixed shaft 282 while the process joining the lower shaft 272*b* with the fixed shaft 282. That is, a predetermined distance between the lower shaft 272*b* and the first compressing member 270.

Furthermore, the vacuum cleaner comprises a driving device rotating the first compressing member 270 as selectively connected to the rotating shaft 272 of the first compressing member 270.

Reference will now be made in detail as for the joining relation between the dust collector 200 and the driving device.

Figure 6:
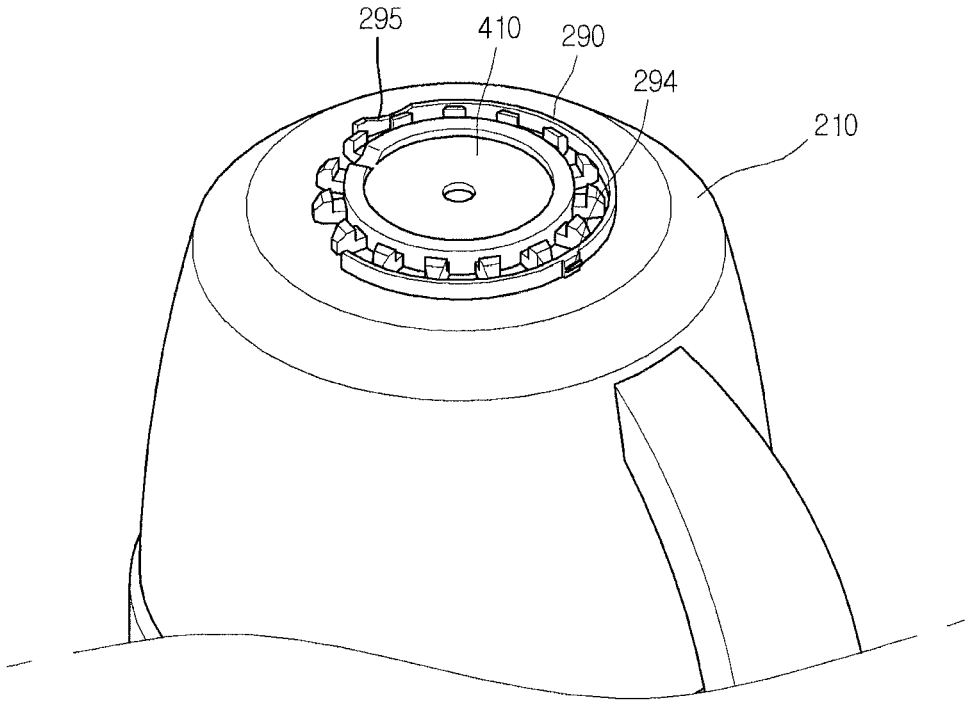
FIG. 6 is a perspective view of the lower part of a dust collector.
Figure 7:
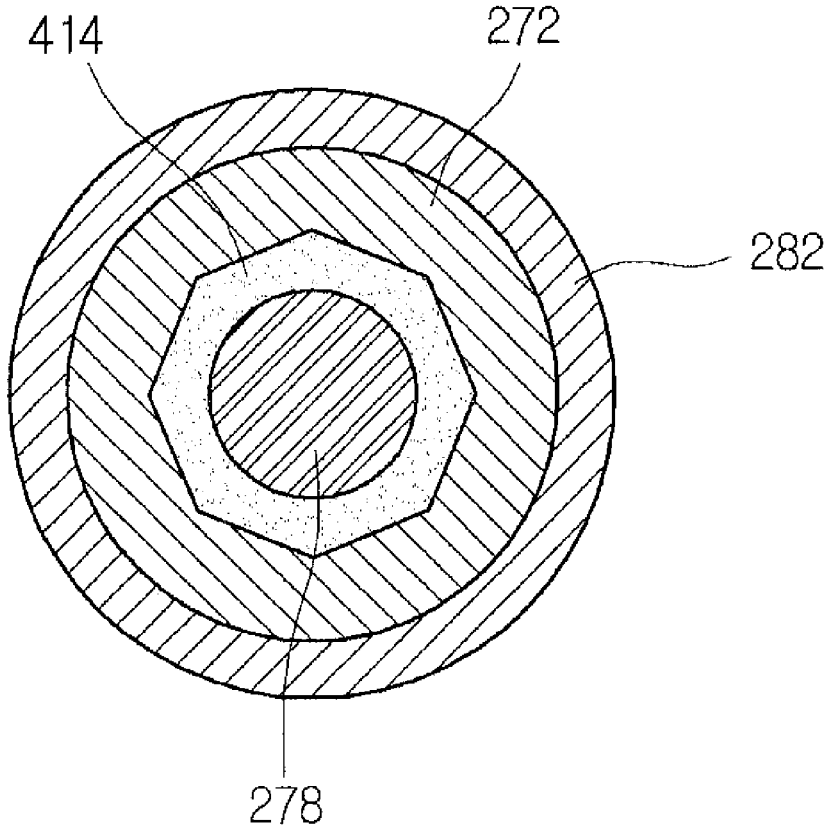
FIG. 7 is a cross-sectional view operated along II-II' in FIG. 4.
Figure 8:
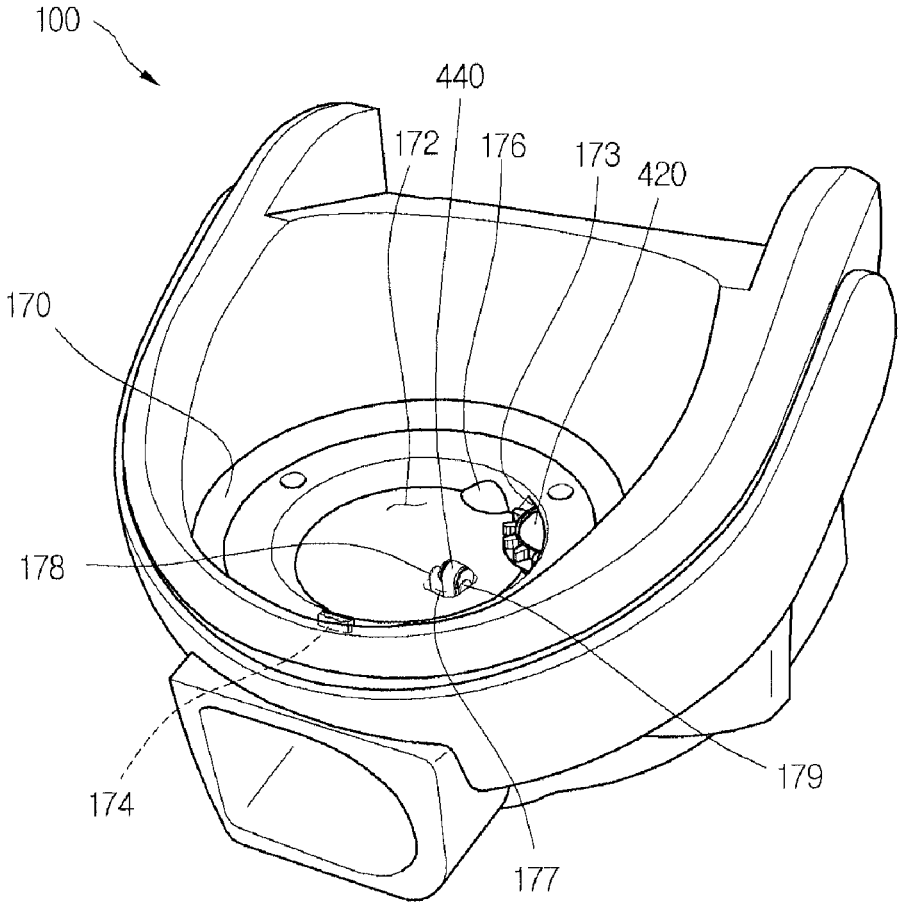
FIG. 8 is a perspective view of a dust collector amount unit.

FIG. 6 is a perspective view of the lower part of a dust collector, FIG. 7 is a cross-sectional view operated along II-II' in FIG. 4, and FIG. 8 is a perspective view of a dust collector amount unit.

Referring to FIGS. 6 to 8, the driving device for rotating the first compressing member 270 includes a compressing motor-illustrated later-generating operation power and a power transfer unit 410 and 420 transferring the power of the compressing motor to the first compressing member 270.

Particularly, the power transfer unit 410 and 420 includes a driven gear 410 joined with the rotating shaft 272 of the first compressing member 270 and a driving gear 420 transferring the power of the compressing motor to the driven gear 420 as joined with the compressing motor.

Therefore, the driving gear 420 joined with the compressing motor is rotated when the compressing motor is rotated, and the driven gear 410 is rotated as the power of the compressing motor is transferred to the driven gear 410 by operating gear 420, and finally, the first compressing member 270 is rotated due to the rotation of the driven gear 410.

Particularly, the gear axis 414 of the driven gear 410 is joined with the rotating shaft 272 of the first compressing member 270 at the lower side of the dust collector body 210.

Further, it is desirable that the inner circumferential surface of the rotating shaft and the horizontal section of the outer circumferential surface of the gear axis 414 of the driven gear 410 are polygonal for the driven gear 410 not to be idled, but to be rotated with the first compressing member 270 at the same time when the driven gear 410 is rotated.

Here, FIG. 7 illustrates the rotating shaft 272 and the gear axis 414 of the driven gear 410 with octagonal horizontal section.

However, the shape of the horizontal section of the rotating shaft 272 and the gear axis 414 is not limited to what is described above, but can be various. That is, it is desirable that the horizontal sections of the rotating shaft 272 and the gear axis 414 are formed in ungrounded shapes, and rotate the first compressing member 270 smoothly while the rotation of the driven gear 410.

Further, it is possible for the coupling member 278 to be coupled at the upper side of the rotating shaft 272 at the state that the driven gear 410 is joined with the rotating shaft 272. Therefore, it is possible that the driven gear 410 and the rotating shaft 272 are coupled strongly, and the idling of the driven gear 410 is further prevented.

The compressing motor is arranged at the lower part of the dust collector mount part 170, and the driving gear 420 is arranged at the bottom of the dust collector mount part 170 as joined with the rotating shaft of the compressing motor.

Further, a part of the outer circumferential surface of the rotating gear 420 is exposed to outside at the bottom of the dust collector mount part 170. For this, an opening 173 is formed to expose a part of the outer circumferential surface of the driving gear 420 to the dust collector mount part 170.

In accordance with the joining of the driven gear 410 at the lower side of the dust collector body 210, the driven gear 410 is exposed to outside of the dust collector body 210, and the driven gear 410 is engaged with the driving gear 420 in accordance with the dust collector 200 is mounted at the dust collector mount part 170

Here, it is desirable for the compressing motor to be a motor capable of rotated in the forward and backward directions.

That is, the motor capable of rotated forward and backward is used for the compressing motor.

Accordingly, the first compressing member 270 is capable of rotating forward and backward, and the dust on the both sides of the second compressing member 280 is compressed in accordance with the first compressing member 270 is rotated in the forward and backward.

On the other hand, a guide rib 290 is formed at the lower side of the dust collector body 210 to guide the mount of the dust collector 200, and an insertion groove 172 in which the guide rib 290 is inserted is formed at the dust collector mount part 170.

Further, the guide rib 290 wraps a part of the driven gear 410 as supplied in the shape of C at the outer side of the driven gear 410. That is, the guide rib 290 is formed as wrapping a part of the driven gear 410 to expose a part of the driven gear to outside, since the driven gear 410 and the driving gear 420 has to be joined with each other when the dust collector 200 is mounted at the dust collector mount part 170 as described above.

The guide rib 290 protects the driven gear 410 and prevents the movement of the dust to the driven gear 410.

Further, a breakaway prevention hole 174 is formed at the dust collector mount part 170 to prevent the breakaway of the cleaner body 10 to the forward at the state that the dust collector 200 is mounted at the dust collector mount part 170, and a breakaway prevention protrusion 294 inserted into the breakaway prevention hole 174 is formed at the guide rib 290.

Therefore, the breakaway of the dust collector 200 is prevented as the breakaway prevention protrusion 294 is engaged with the breakaway prevention hole 174, even though the dust collector 200 is pulled in the forward direction when it is mounted at the dust collector mount part 170 by the breakaway prevention hole 174.

Further, a set unit 176 is formed at the dust collector mount part 170 to lead the set of the guide rib 290, and a set groove 295 corresponding to the set unit 176 is formed at the guide rib 290.

The dust collector 200 is easily mounted at the dust collector mount part 170 by the set unit 290 and the set groove 295, and the shaking of the dust collector 200 at the state mounted at the dust collector mount part 170 is prevented.

A micro switch-described later- is supplied at the lower part of the dust collector mount part 170 to perceiving the rotating location of the driven gear 410. Further, a lever 440 is exposed to the dust collector mount part 170 for the micro switch 430 to be on and off as contacted to the driven gear 410.

For this, a penetration hole 177 is formed at the dust collector mount part 170 to expose a part of the lever 440. Further, an inner rib 178 and an outer rib 179 are formed at the dust collector mount part 170 to protect the lever 440 that a part is exposed.

Reference will now be made in detail as for the operating relation of the driven gear and the micro switch.

Figure 9:
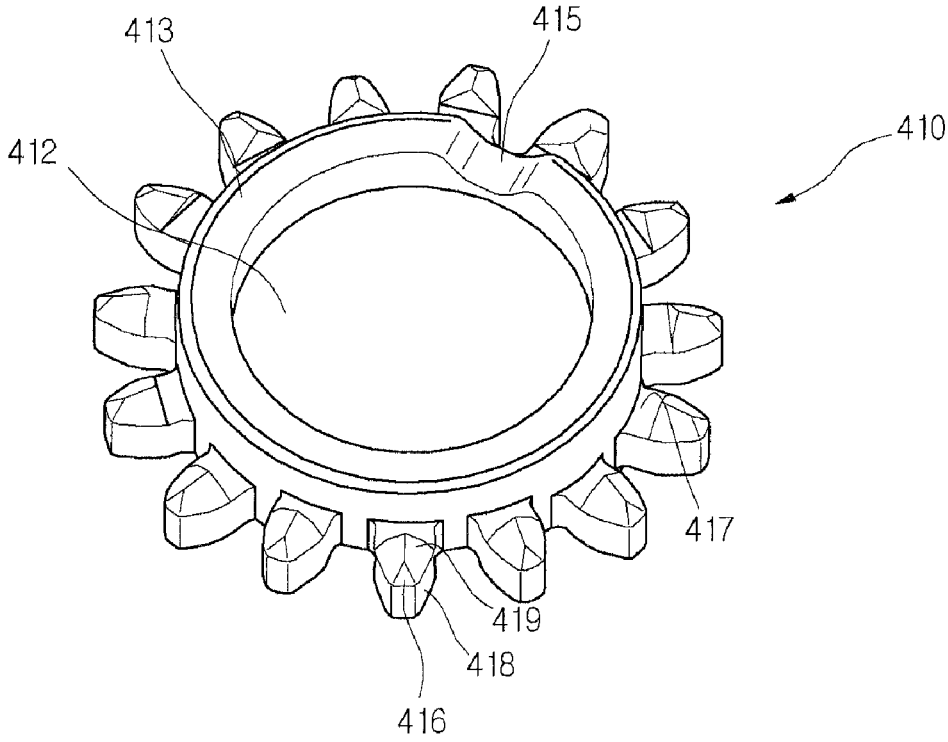
FIG. 9 is a perspective view of the lower part of a driven gear.

FIG. 9 is a perspective view of the lower part of a driven gear.

Figure 10:
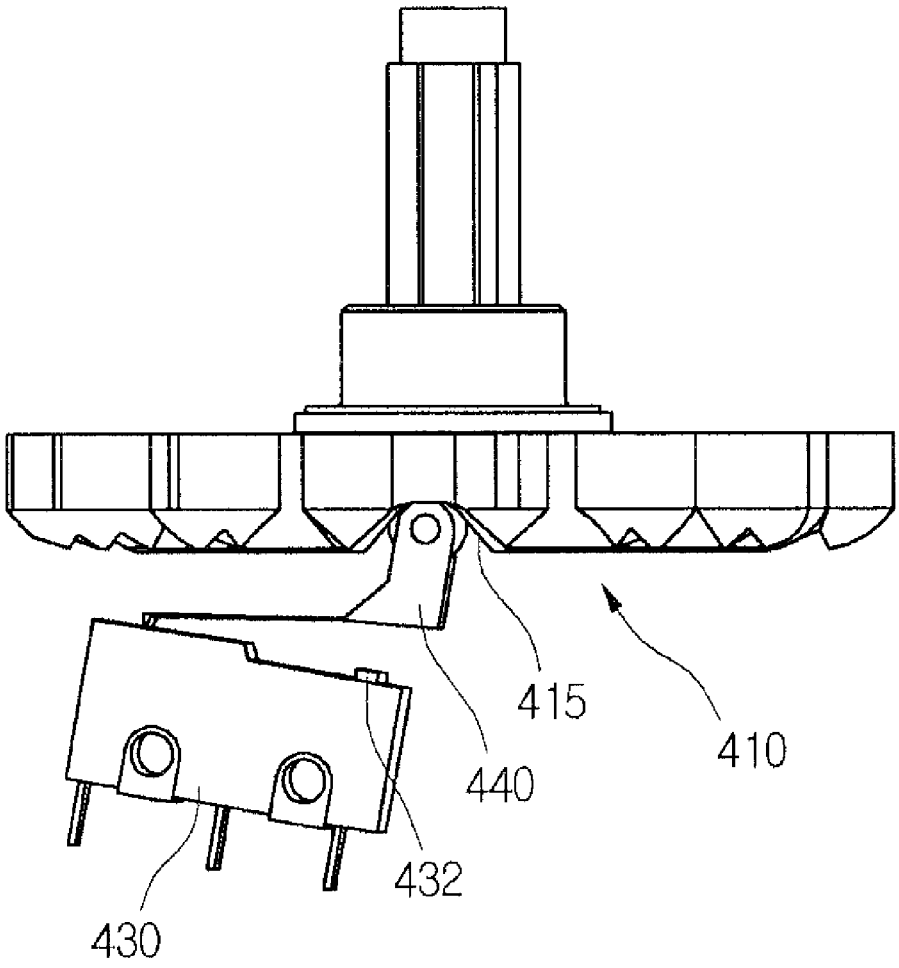
FIG. 10 is a view illustrating the location relation of a driven gear and a micro switch.

Referring to FIGS. 9 to 10, the micro switch 430 is positioned at the lower part of the driven gear 410 for the lever 440 allowing the micro switch 430 to be on and off to be faced with the lower side of the driven gear 410.

The driven gear 410 includes a body unit 412 of round board shape, a contact rib 413 contacting to the lever 440 as extended to the lower direction from the lower part of the body unit 412, and a multitude of gear tooth 416 formed along the circumference of the lateral surface of the body unit 412.

Particularly, a confirmation groove 415 is formed at the contact rib 413 to confirm the rotating location of the driven gear 410 as preventing the driven gear 410 to be contacted to the lever 440 at the state that the driven gear 410 is rotated to the predetermined location. Here, the description that the lever 440 and the contact rib 413 are not contacted to each other means that the lever 440 is not contacted to the bottom of the contact rib 413 as a part of the lever 440 is put into the confirmation groove 415.

Further, the lever 440 exposed through the penetration hole 177 presses the contact point 432 of the micro switch 430 as contacted to the bottom of the contact rib 413 when the dust collector 200 is mounted at the dust collector mount part 170. Further, the lever 440 recedes from the contact point 432 as a part of the lever 400 is inserted into the location confirmation groove 415 when the driven gear 410 is moved to a predetermine location as rotated.

Here, the micro switch 430 is off when the lever 440 is located at the location confirmation groove 415, and is maintained to be always on excluding the afore-mentioned case, contacted to rib 413.

An interference prevention groove 417 is formed at the lower side of the gear tooth 416 to prevent the interference with the outer rib 178 while the dust collector 200 is mounted.

Accordingly, the outer rib 179 is located at the interference prevention groove 417, and the inner rib 178 is located at the space formed by the contact rib 413 when the dust collector 200 is mounted at the dust collector mount part 170.

Further, each of the gear teeth 416 has both sides rounded in a predetermined curvature. The both sides of the gear tooth 416 of driven gear 410 is rounded for the easy coupling of the driven gear 410 and the operating fear 420, since the driven gear 410 is coupled with the driving gear 420 as the dust collector 200 is mounted at the dust collector mount part 170.

Furthermore, a pair of inclined planes 419 is formed at the lower side of each of the gear tooth 416 for the easy coupling of the driven gear 410 and the driving gear 420. The pair of inclined planes 419 meets each other at the center of the gear tooth 416.

The driven gear 410 and the driving gear 420 are exactly coupled to each other as the inclined plane 419 of the gear tooth 416 and the gear tooth of the driving gear 420 are sliding while the driven gear 410 and the driving gear 420 are coupled due to the above-mentioned structure.

Here, the gear tooth of the driving gear 420 is formed in a shape corresponding to the gear tooth of the driven gear 410, and the detailed description thereof is omitted.

Figure 11:
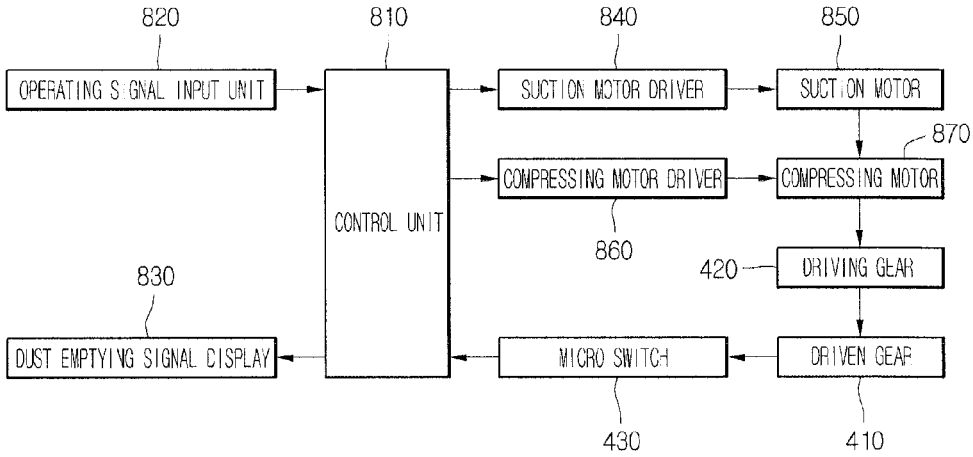
FIG. 11 is a block diagram illustrating the control device of a vacuum cleaner.

FIG. 11 is a block diagram illustrating the control device of a vacuum cleaner.

Referring to FIG. 11, the vacuum cleaner basically carries a control unit 810, an operating signal input unit 820 selecting the suction power for dust (ex, strong, medium, and weak mode), a dust emptying signal display unit 830 displaying the signal informing the time to dump the dust collected in the dust collector 200 through a light radiating element such as an LED, a suction motor driver 840 operating the suction motor 850 which is an operating motor to inhale the dust into the inside in accordance with the operation modes (ex, strong, medium and weak) input through the operating signal input unit 820, a compressing motor driver 860 operating the compressing motor 870 used for compressing the dust stored in the dust collector 200, a driving gear 420 operated by the compressing motor 870, a driven gear 410 rotated as engaged with the driving gear 420, and a micro switch being on and off in accordance with the rotation of the driven gear 410.

Particularly, the control unit 810 controls the suction motor driver 840 to operate the suction motor 850 with the suction power corresponding to the modes of strong, medium and weak when a user selects one of the modes of strong, medium and weak indicating the suction power through the operating signal input unit 820. That is, the suction motor driver 850 operates the suction motor 850 with a predetermined suction power in accordance with the signal transferred from the control unit 810.

The control unit 810 operates the compressing motor 870 as operating the compressing motor driver 860 at the same time operating the suction motor driver 840 or after operating the suction motor driver 840.

Here, a synchronous motor can be used for the compressing motor 870 for the forward and backward rotation of the first compressing member 270 to be possible as described above.

The synchronous motor is composed as the forward and backward rotation is possible only by the motor itself, and the rotating direction of the motor is turned to the other direction when the power applied to the motor becomes over a predetermined setting while the rotation of the motor in one direction.

At this time, the power applied to the motor is a torque generated in accordance with the first compressing member 270 compresses dust, and the direction of rotation of the motor is changed when the torque reaches the set point.

The detailed description for the synchronous motor is omitted, as it is generally known in the technical field of motors. Mealy, it is one of the technical ideas of the present implementations that the forward and backward rotation of the motor is possible by the synchronous motor.

Further, it is desirable for the first compressing member 270 continuously for a predetermined time, even when the first compressing member 270 reaches the max that it is impossible for the first compressing member 270 to be rotated as compressing dust as rotating.

Here, the max that it is impossible for the first compressing member 270 to be rotated means the case that the torque reaches the set point.

Further, when the torque reaches the set point, the power rotating the first compressing member 270, the power applied to the compressing motor 870, is broken for a predetermine time so as to maintain the state that the dust is compressed at the state that the first compressing member 270 is stopped, and the first compressing member 270 can be operated again after passing a predetermined time as applying the power to the compressing motor 870.

Here, the rotating direction of the compressing motor 870 becomes the opposite direction of the direction before the breaking when the compressing motor 870 is operated again, as the breaking time of the power applied to the compressing motor 870 is when the torque is reached the set point.

Further, it is desirable for the compressing motor 870 to rotate the first compressing member 270 in the left and right direction continuously with the same speed to compress dust easily.

Dust is compressed by the first compressing member 270 moving as rotated back and forth continuously when the compressing motor 870 is operated as above. Further, the time for the rotation in the left and right directions of the first compressing member 270 becomes shortened as the amount of the dust compressed in the dust collector 200 is increased. Here, when the time for the rotation in the left and right directions of the first compressing member 270 becomes less than a predetermined time as the amount of the dust compressed as inhaled into the dust collector 200 is stored as a predetermined amount, the control unit 810 sends a signal indicating the time to empty the dust collector 200 having the collected dust to the dust emptying signal display unit 830 with a basis of the afore-mentioned information.

Figure 12:
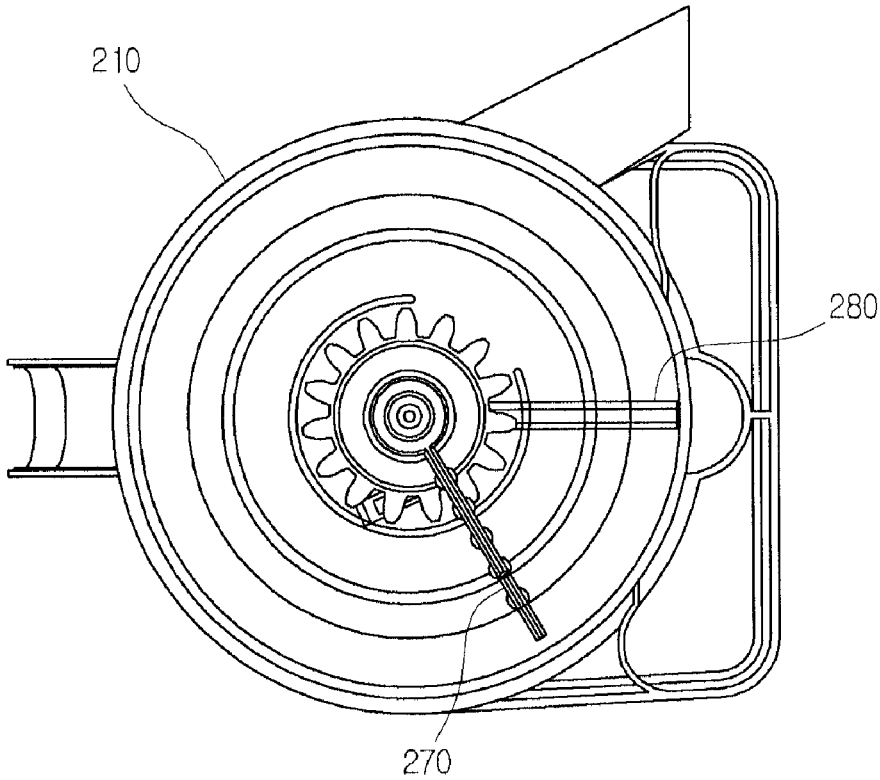
FIGS. 12 and 13 are views to describe the state that the micro switch is on when the first compressing member is close to a side of the second compressing member to compress dust.
Figure 13:
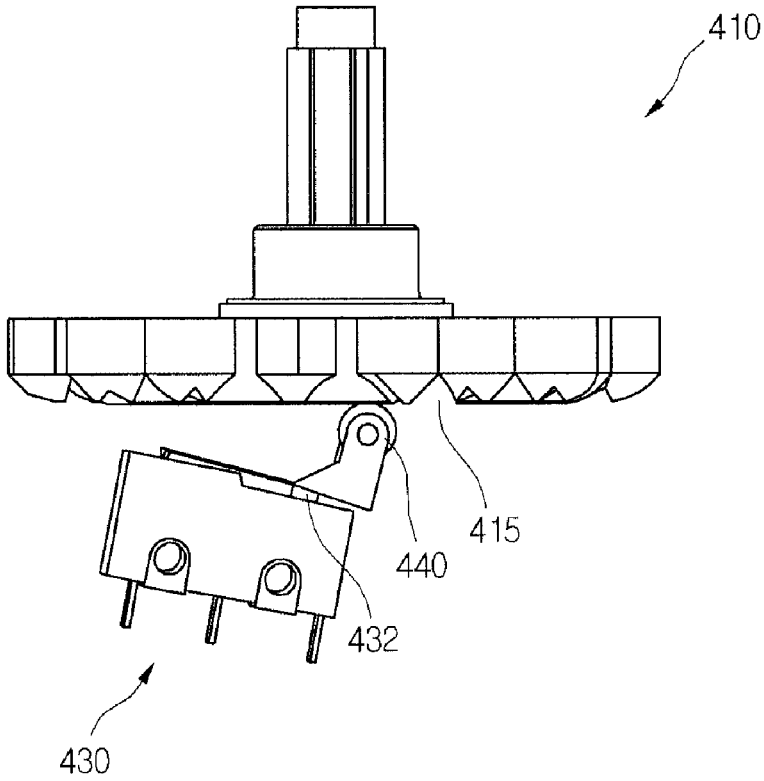
Figure 14:
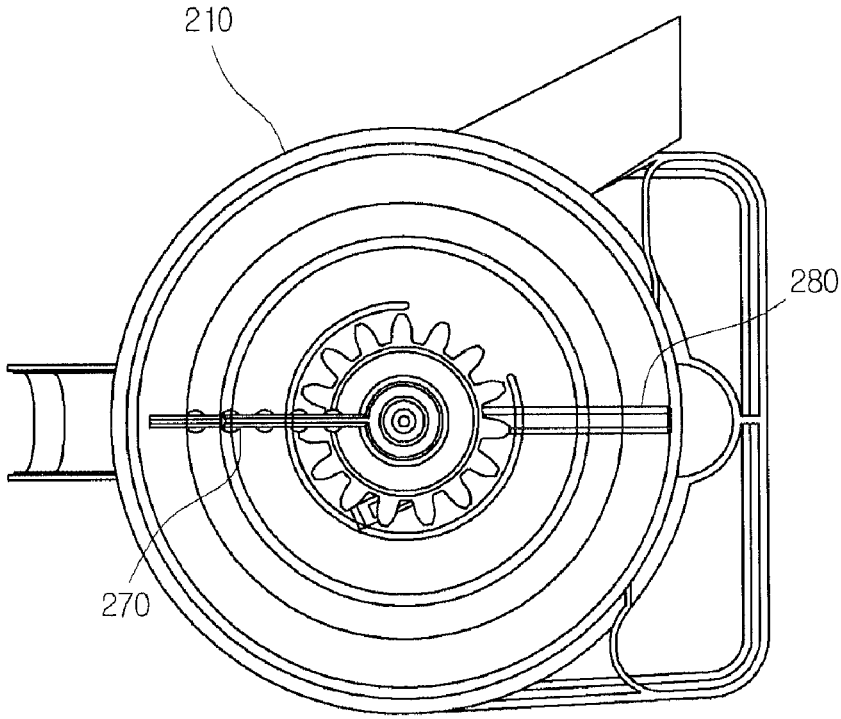
FIGS. 14 and 15 are views to describe the state that the micro switch is off when the first compressing member and the second compressing member are located on the straight line.
Figure 15:
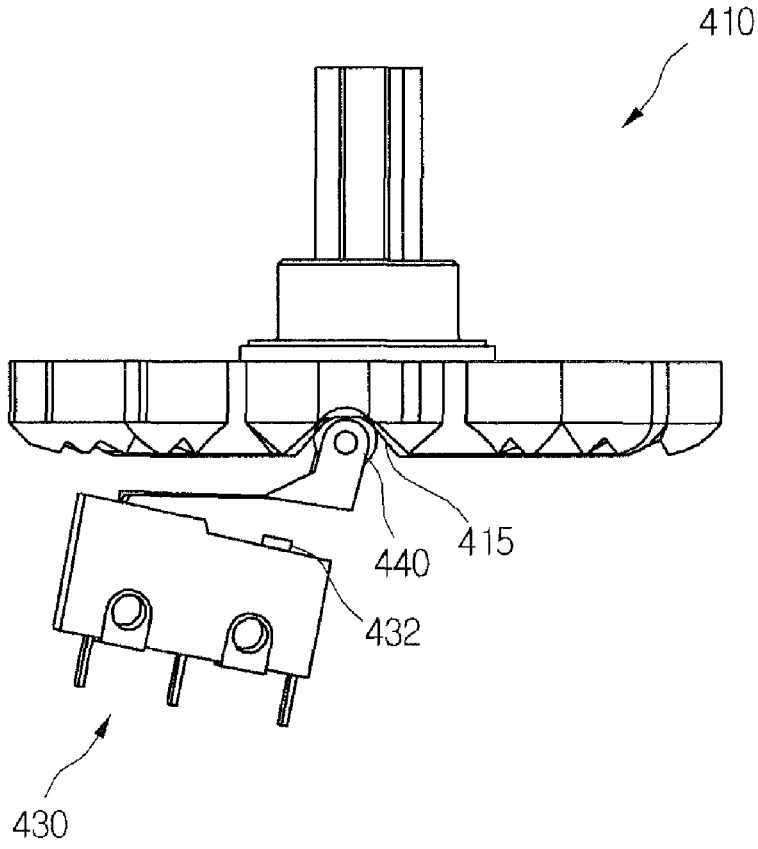
Figure 16:
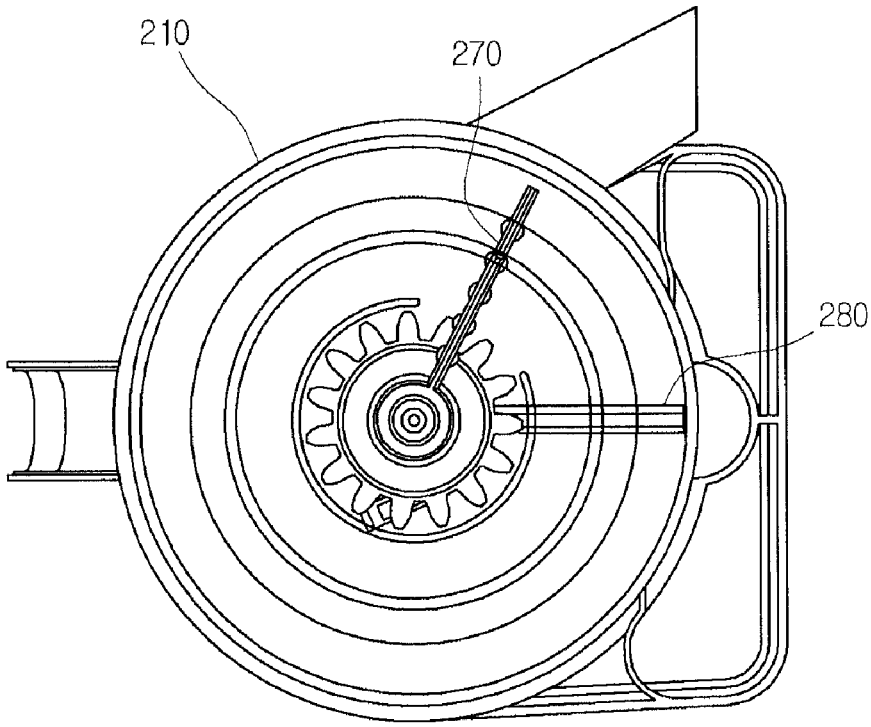
FIGS. 16 and 17 are views to illustrate the state that the micro switch is on when the first compressing member is close to another side of the second compressing member.
Figure 17:
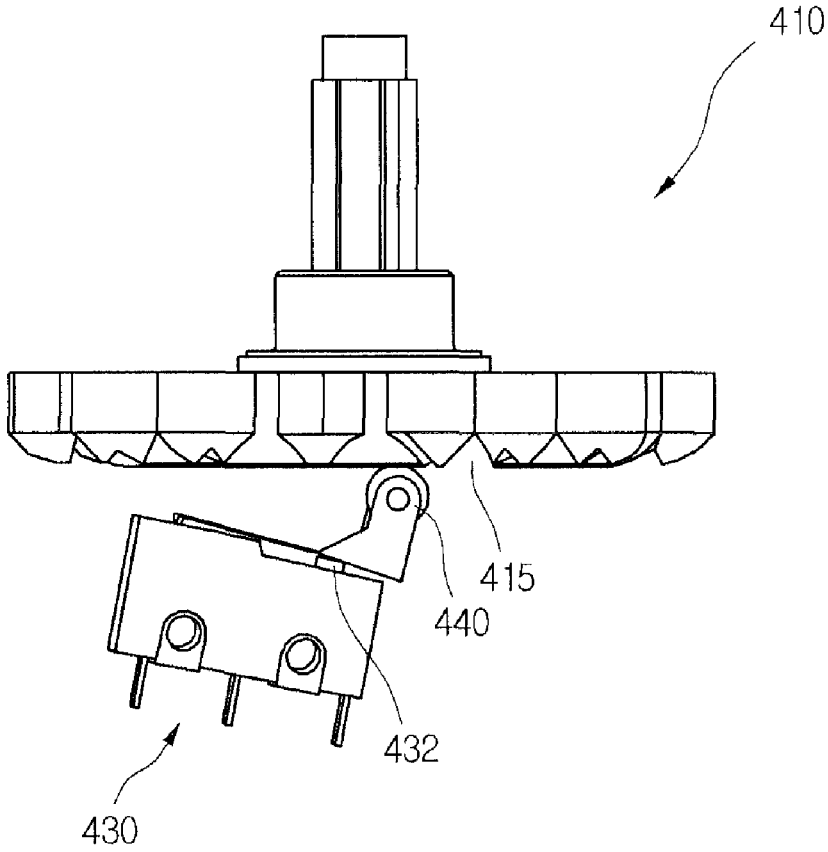

FIGS. 12 and 13 are views to describe the state that the micro switch is on when the first compressing member is close to a side of the second compressing member to compress dust, FIGS. 14 and 15 are views to describe the state that the micro switch is off when the first compressing member and the second compressing member are located on the straight line, and FIGS. 16 and 17 are views to illustrate the state that the micro switch is on when the first compressing member is close to another side of the second compressing member.

Referring to FIGS. 12 to 17, the lever 440 locates at the location confirmation groove 415 of the driven gear 410, when the first compressing member 270 locates on the straight line as rotated about the 180° with the second compressing member 280 as a standard. In this case, the micro switch 430 becomes off as the lever 440 is apart from the contact point 432.

Here, the location of the first compressing member 270 illustrated in FIG. 14 that the micro switch 430 is off is called the standard location for the convenience of description.

The micro switch 430 becomes on, as illustrated in FIG. 13 as the lever 440 presses the contact point 432, since it contacts to the contact rib 413 of the driven gear 410 while the first compressing member 270 compresses the dust in the dust collector body 210 as rotated in the opposite direction of the clockwise direction from the standard location.

When it is impossible for the first compressing member 270 rotated in the opposite direction of the clockwise direction to be rotated any more due to the dust, the first compressing member 270 is rotated in the clockwise direction. Therefore, the first compressing member 270 compresses the dust in the dust collector body 210 as rotated in the right direction of the second compressing member 280 as illustrated in FIG. 16 after passing the standard location illustrated in FIG. 14.

Further, when it is impossible for the first compressing member 270 rotated in the clockwise direction to be rotated any more due to the dust, the compressing motor 870 let the dust in the dust collector compressed as rotating the first compressing member 270 in the opposite direction of the clockwise direction as repeating the above-mentioned process.

Figure 18:
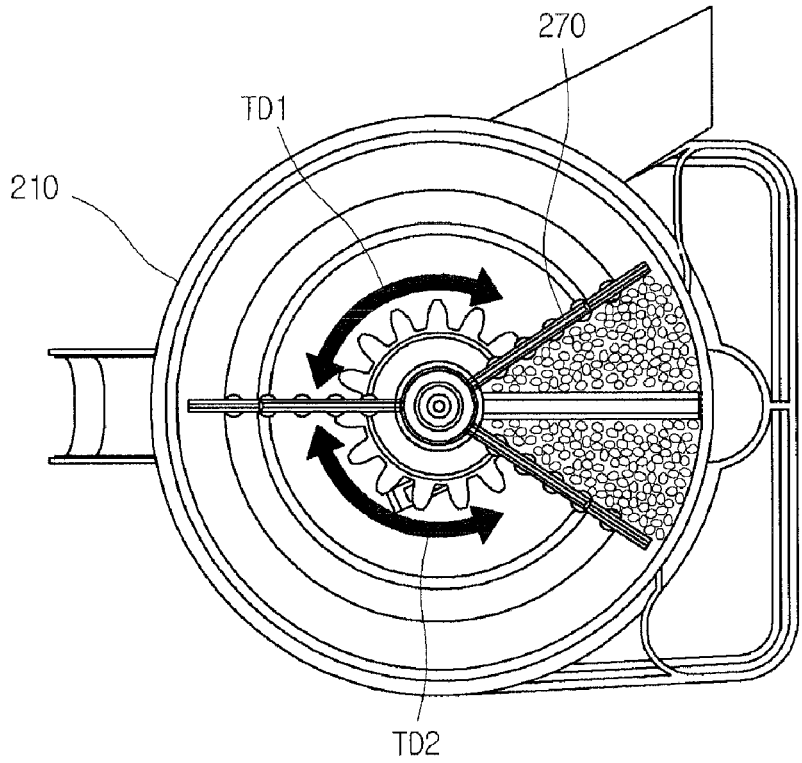
FIG. 18 is a view to illustrate the whole rotating operation of the first compressing member illustrated in FIGS. 12 to 17.

FIG. 18 is a view to illustrate the whole rotating operation of the first compressing member illustrated in FIGS. 12 to 17.

The time TD1 required for the first compressing member 270 to reach back to the standard location as rotated in the clockwise direction from the standard location, and the time TD2 required for the first compressing member 270 to reach back to the standard location as rotated in the opposite direction of the clockwise direction from the standard location are illustrated in FIG. 18. For the convenience of description, the time TD1 is called as the first return time and the time TD2 is called as the second return time. In general, the first return time TD1 and the second return time TD2 are almost the same, since dust spreads evenly in the dust collector body 210.

On the other hand, the more the amount of the dust compressed by the first compressing member 270 becomes, the shorter the return times TD1 and TD2 becomes.

In this implementation, the signal to dump the dust is displayed as it is decided that the enough dust is stored in the dust collector 210 when one of the return times TD1 and TD2 reaches a predetermined standard time.

Reference will now be made in detail as for the operation and the dust compressing process of the vacuum cleaner.

Figure 19:
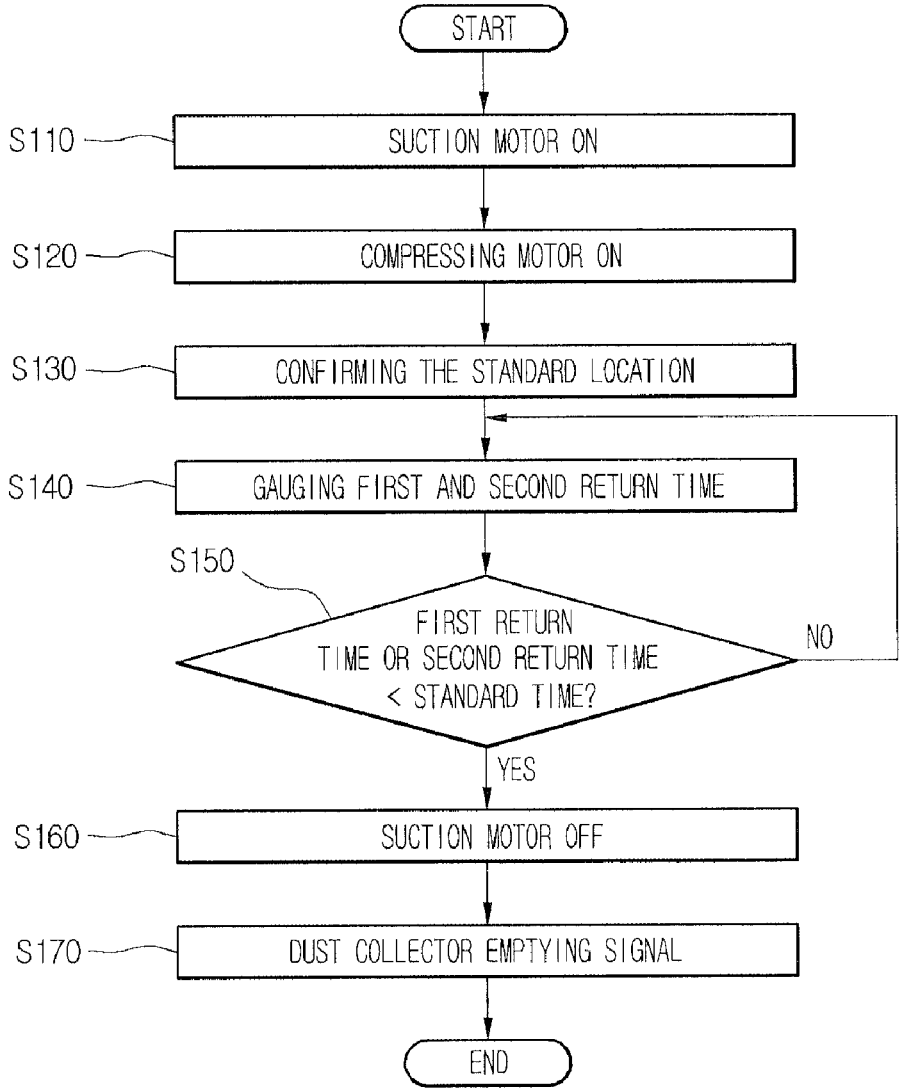
FIG. 19 is a flowchart illustrating the controlling method of a vacuum cleaner.

FIG. 19 is a flowchart illustrating the controlling method of a vacuum cleaner.

Referring to FIG. 19, a user operates the vacuum cleaner as selecting one of the suction powers of strong, medium and weak modes displayed on the operation signal input unit 820. Then, the control unit 810 operates the suction motor driver 840 for the suction motor 850 to be operated in accordance with the suction mode selected by the user S110.

When the suction motor 850 is operated, dust is inhaled through the suction nozzle by the suction power of the suction motor 850. Then, the air inhaled through the suction nozzle is flown into the cleaner body 100 through the body suction unit 110, and the flown air is inhaled into the dust collector 200 as passing through some paths.

Particularly, the air including dust is inhaled toward the contact line of the first cyclone unit 230 through the first air inlet 218 of the dust collector body 210. Further, the inhaled air falls down as circulating along the inner circumferential surface of the first cyclone unit 230, and the air and the dust are separated from each other in this step as receiving different centrifugal force because of the weight difference.

Further, the air separated from the dust is exhausted to outside of the dust collector 200 through the discharge hole 251 and the first air outlet 252 after filtered through the void 262 of the filter member 260.

On the other hand, the separated dust is inhaled into the dust guide path 232 toward contact line at the step rotated along the inner circumferential surface of the first cyclone unit 230.

Further, the dust inhaled into the dust guide path 232 flows along the outer circumferential surface of the first cyclone unit 230 as the flowing direction is changed in the dust guide path 232, and is stored in the first dust storage part 214 as falling down through the outlet 234.

The air exhausted through the first air outlet 252 is inhaled into the cleaner body 100. The air inhaled into the cleaner body 100 is inhaled into the second cyclone unit 300 after passing through the connection path 114.

Further, the air is leaded to the contact line of the inner wall of the second cyclone unit 300 through the second air inlet—not illustrated—connected to an end of the connection path 114, and is separated from the dust once more.

Furthermore, the air separated from the dust once more is inhaled into the cleaner body 100. Then, the air inhaled into the cleaner body 100 is exhausted to outside through the body outlet of the cleaner body 100 after passing through the suction motor.

On the other side, the separated dust is inhaled into the dust collector 200 through the dust inlet 254, and is finally stored in the second dust storage part 216.

On the process that the dust included in the air is stored in the dust storage part after separated from the air as described above, the pair of compressing members 270 and 280 compresses the dust stored in the first dust storage part 214.

That is, the control unit 810 operates the compressing motor 870 to compress the dust stored in the dust collector body 210 (S120).

Here, this implementation adopts the method that the compressing motor 870 is operated after operating the suction motor 850, however, it is possible that the suction motor 850 and the compressing motor are operated at the same time as another preferred embodiment.

Further, when the compressing motor 870 is operated, the operation gear 420 coupled with the compressing motor 870 is rotated. When the operation gear 420 is rotated, the driven gear 410 is rotated as connected with the rotation of the operation gear 420. When the driven gear 410 is rotated, the first compressing member 270 coupled with the driven gear 410 compresses the dust as automatically rotated toward the second compressing member 280.

Here, the control unit 810 checks if the first compressing member 270 is located at the standard location S130. It is necessary to check if the first compressing member 270 is located at the standard location when the first operation, since this implementation is gauging the first and the second return times with the standard location of the first compressing member 270 as a standard location. That the first compressing member 270 locates at the standard location means the point of the time that the micro switch 430 is off for the first time while the first operation.

Accordingly, the control unit 810 gauges the first and the second return time with the point of the time that the micro switch 430 is off for the first time as a standard.

Further, the control unit 810 gauges the first TD1 and the second TD2 return times in accordance with the movement of the first compressing member 270 in the opposite direction of the clockwise direction or the clock wise direction form the point of time that the first compressing member 270 is moved to the standard location as a standard S140.

Here, as the amount of the dust compressed by the first compressing member 270 and the second compressing member 280 in the dust collector body 210, the return time in the left and right direction becomes shortened.

The control unit 810 decides if the first return time TD1 or the second return time TD2 is reached a predetermined standard time as gauging the first return time TD1 and the second return time TD2 of the first compressing member 270 through the micro switch 430. Here, the predetermined standard time is the time set in the control unit by a projector, and it becomes the basis to decide that more than a predetermined amount of dust is stored in the dust collector body 210. The standard time is obtained as experimented repeatedly for several times by the projector, and becomes different in accordance with the capacity of the vacuum cleaner.

In the present implementation adopted the method deciding that the amount of the dust reaches a predetermined amount when one of the first return time TD1 or the second return time TD2 reaches the standard time, however, it is possible that the basis of the decision is the case that both of the first return time TD1 and the second return time TD2 reaches the predetermined time as another preferred embodiment.

As a result of decision at the step S150, in case that anyone between the first return time TD1 and the second return time TD2 is longer than the standard time, they return to the step S140 and perform the former process.

On the contrary, in case that the first return time TD1 or the second return time TD2 is reached the standard time, the control unit 810 controls as dust is not inhaled more as turning off the suction motor 850 S160. Here, the reason stopping the suction motor forcibly is because the dust suction efficiency is reduced and the suction motor 850 is overloaded if the suction operation for the dust is continued forcibly when the amount of the dust in the dust collector body 210 is more than the predetermined amount. At this time, it is desirable to turn off the compressing motor 870 with the suction motor.

Next, the control unit 810 notifies the user the time to throw out the dust as sending the signal indicating the time to throw the dust in the dust collector body 210 away to the dust emptying signal display unit 830 S170. As another preferred implementation of the vacuum cleaner, it is possible for the dust dump signal to be displayed with a predetermined sound signal as using buzzer circuit.

The vacuum cleaner has some advantages in that the convenience for the users is improved as the time to empty the dust collector 200 having dust is notified to the users, and that the reduction of operation efficiency of the cleaner in accordance with the excessive dust suction is prevented as controlling the operation of the suction motor at the process performing the dust collector emptying informing function.

On the other hand, it is possible that the technical idea of the implementation of the vacuum cleaner described above is applicable for the up-light type cleaners or robot cleaners.

Figure 20:
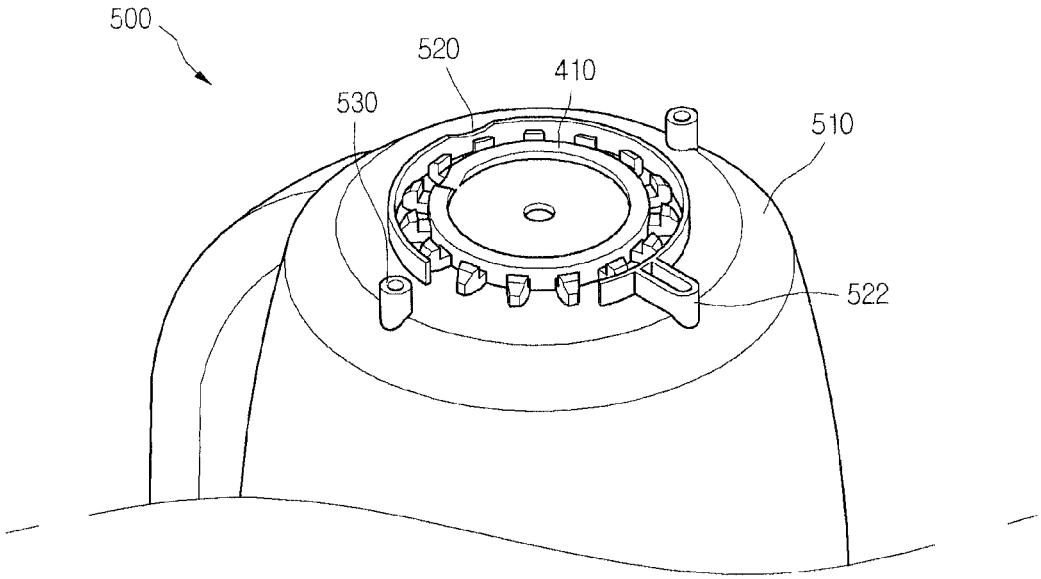
FIG. 20 is a perspective view of the lower part of a dust collector according to a second implementation of a vacuum cleaner.
Figure 21:
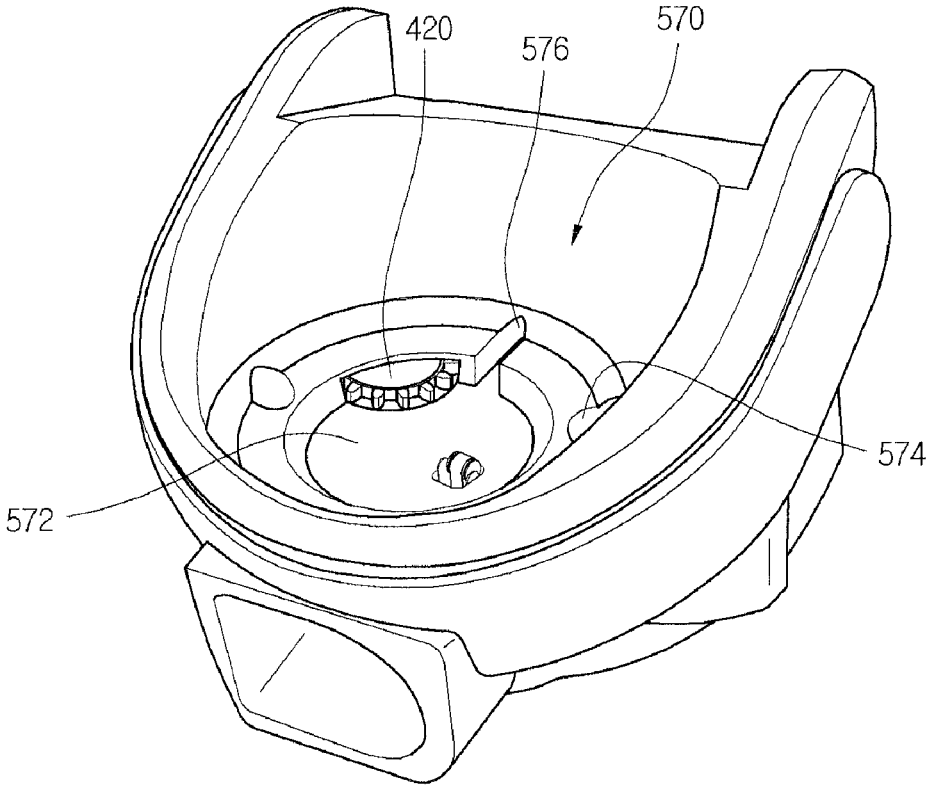
FIG. 21 is a perspective view of a dust collector mount part according to the second implementation of a vacuum cleaner.

FIG. 20 is a perspective view of the lower part of a dust collector according to the second implementation of the vacuum cleaner, and FIG. 21 is a perspective view of a dust collector mount part according to the second implementation of the vacuum cleaner.

Referring to FIGS. 20 and 21, a guide rib 520 is formed at the lower side of the dust collector body 510 to guide the mount of the dust collector 500 to the cleaner body 100, and an insertion groove 572 in which the guide rib 520 is inserted is formed at the dust collector mount part 570.

The guide rib 520 is supplied to the outer side of the driven gear 410 in the shape of C and wraps a part of the driven gear 410. Further, at least a pair of guide protrusion 530 is formed at the lower side of the dust collector body to lead the mount of the dust collector 500, and a protrusion insertion groove 574 in which the guide protrusion 530 is inserted is formed at the dust collector mount part 570.

Further, a shaking prevention rib 522 is formed as extended at the guide rib 520 at the lower side of the dust collector to prevent the shaking of the dust collector at the state mounted at the dust collector mount part 570 as well as guiding the mount of the dust collector 500.

Further, a rib insertion groove 576 in which the shake prevention rib 522 is inserted is formed at the dust collector mount part 570. Here, the rib insertion groove 576 is formed at the place further than the protrusion insertion groove 574 in the view from the front of the cleaner body 100. That is, the assumed line connecting the protrusion insertion groove 574 and the rib insertion groove 576 forms a triangle.

Accordingly, when the dust collector 500 is mounted at the state that the guide protrusion 530 and the protrusion insertion groove 574 are arranged, the guide protrusion 530 is inserted into the protrusion insertion groove 574 for the first of all, and then, the dust collector 500 is easily and correctly mounted in accordance with the shaking prevention rib 522 is inserted into the rib insertion groove 576.

Further, the shaking of the dust collector 500 is effectively prevented while the vacuum cleaner is operated in accordance with the guide protrusion 530 and the shaking prevention rib 522 protruded to out side of the dust collector is inserted into the protrusion insertion groove 574 and the rib insertion groove 576formed at the dust collector mount part 570.

The idea of the implementations of the vacuum cleaner is not limited to the above-mentioned-description, therefore, another preferred embodiment such as following is further included.

It is possible that a magnetic member generating magnetism at the lower part of the dust collector mount part and a magnetic substance capable of joined with the magnetic member at the dust collector are supplied. Here, it is possible that a metal member is used for the magnetic substance for example.

In this case, it is possible that the understructure of the dust collector and the structure of the dust collector mount part become simplified.

Furthermore, in case that the dust collector is located close to the dust collector mount part to mount the dust collector, the mount of the dust collector can be guided due to the interaction of the magnetic member and the metal member, and the shaking of the dust collector is further prevented as the dust collector is magnetically joined with the dust collector mount part at the state that the dust collector is mounted at the dust collector.

Here, it is possible that a magnetic member is supplied to the dust collector and a magnetic substance is supplied to the lower part of the dust collector mount part.

What is claimed is:

1. A vacuum cleaner, comprising:

a main body including a suction motor that generates a suction power and a mounting part;

a dust separator that communicates with the suction motor and separates dust and dirt from air;

a dust collector body configured to store dust separated from the dust separator, the dust collector body being detachably mounted on the mounting part of the main body;

at least one plate provided within the dust collector body and configured to compress dust stored in the dust collector body; and a transfer device comprising at least one gear provided outside of the dust collector body, the transfer device being configured to transfer a driving force to the at least one plate, wherein the mounting part of the main body includes a receptacle that receives at least a portion of the transfer device in a state in which the dust collector body is mounted on the mounting part of the main body.

2. The vacuum cleaner according to claim 1, wherein the dust collector body includes a cover that covers at least a portion of the transfer device, and wherein the cover is received in the receptacle in a state in which the dust collector body is mounted on the mounting part of the main body.

3. The vacuum cleaner according to claim 1, further comprising a first guide configured to guide mounting of the dust collector body on the mounting part of the main body and formed on the dust collector body, and a second guide configured to interact with the first guide and formed on the dust collector body.

4. The vacuum cleaner according to claim 3, wherein the first guide comprises at least one protrusion that protrudes from the dust collector body, and the second guide comprises an insertion groove in which the at least one protrusion is inserted formed on the mounting part of the main body.

5. The vacuum cleaner according to claim 3, wherein the first guide comprises a set groove formed on a lower side of the dust collector body, and the second guide comprises a set protrusion inserted into the set groove formed on the mounting part of the main body.

6. The vacuum cleaner according to claim 1, further comprising a drive device that generates the driving force to move the at least one plate and a driving gear connected to the drive device, wherein the at least one gear of the transfer device includes a driven gear engaged with the driving gear.

7. The vacuum cleaner according to claim 6, wherein the drive device and the driving gear are each provided on the main body.

8. The vacuum cleaner according to claim 7, wherein at least a portion of the driving gear is located in the receptacle.

9. The vacuum cleaner according to claim 1, wherein the transfer device is provided at a lower side of the collector body.

10. The vacuum cleaner according to claim 1, wherein the receptacle comprises a recess formed in the mounting part of the main body.

11. The vacuum cleaner according to claim 1, wherein the at least one plate comprises a plurality of protrusions disposed on a surface thereof.

12. A vacuum cleaner, comprising:

a main body including a suction motor that generates a suction power and a mounting part;

a dust separator that communicates with the suction motor and that separates dust and dirt from air;

a dust collector body configured to store dust separated from the dust separator, the dust collector body being detachably mounted on the mounting part of the main body;

at least one plate provided within the dust collector body and configured to compress dust stored in the dust collector body;

a drive device configured to generate a driving force to move the at least one plate;

a first guide provided on the dust collector body and configured to guide mounting of the dust collector body on the mounting part of the main body; and a second guide provided on the mounting part of the main body and configured to interact with the first guide, wherein at least a portion of the drive device is located at the mounting part when the dust collector body is mounted on the mounting part, and wherein the first guide comprises at least one protrusion that protrudes from the dust collector body, and the second guide comprises an insertion groove in which the at least one protrusion is inserted formed on the mounting part of the main body.

13. A vacuum cleaner, comprising:

a main body including a suction motor that generates a suction power and a mounting part;

a dust separator that communicates with the suction motor and separates dust and dirt from air;

a dust collector body configured to store dust separated from the dust separator, the dust collector body being detachably mounted on the mounting part of the main body;

at least one plate provided within the dust collector body and configured to compress dust stored in the dust collector body;

a drive device configured to generate a driving force to move the at least one plate;

a first guide provided on the dust collector body and configured to guide mounting of the dust collector body on the mounting part of the main body; and a second guide provided on the mounting part of the main body and configured to interact with the first guide, wherein at least a portion of the drive device is located at the mounting part when the dust collector body is mounted on the mounting part, and wherein the first guide comprises a set groove formed at a lower side of the dust collector body, and the second guide comprises a set protrusion inserted into the set groove formed on the mounting part of the main body.

14. The vacuum cleaner according to claim 13, further comprising a transfer device comprising at least one gear configured to transfer the driving force from the drive device to the at least one plate, wherein the at least one gear comprises a plurality of gears, and wherein at least one of the plurality of gears is connected to the at least one plate.

15. The vacuum cleaner according to claim 14, wherein the at least one of the plurality of gears is provided under the dust collector body.

16. The vacuum cleaner according to claim 15, wherein the first guide covers at least a portion of the at least one of the plurality of gears.

* * * * *